US009939787B2

(12) United States Patent
Baek et al.

(10) Patent No.: US 9,939,787 B2
(45) Date of Patent: Apr. 10, 2018

(54) WEARABLE ELECTRONIC DEVICE WITH ELECTRONIC COMPONENT IN STRAP

(71) Applicant: Samsung Electronics Co., Ltd., Gyeonggi-do (KR)

(72) Inventors: Sang-In Baek, Gyeonggi-do (KR); Hong-Moon Chun, Gyeonggi-do (KR); Dae-Young Noh, Seoul (KR); Hee-Cheul Moon, Gyeonggi-do (KR); In-Youl Baek, Gyeonggi-do (KR); Jong-Kuck Son, Gyeonggi-do (KR); Jin-Chul Choi, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 208 days.

(21) Appl. No.: 14/472,777

(22) Filed: Aug. 29, 2014

(65) Prior Publication Data

US 2015/0063075 A1 Mar. 5, 2015

(30) Foreign Application Priority Data

Sep. 2, 2013 (KR) ..... 10-2013-0105144

(51) Int. Cl.

| | |
|---|---|
| ***G04G 17/04*** | (2006.01) |
| ***G04G 17/06*** | (2006.01) |
| ***G04G 21/04*** | (2013.01) |

(52) U.S. Cl.

CPC ..... *G04G 17/04* (2013.01); *G04G 17/06* (2013.01); *G04G 21/04* (2013.01)

(58) Field of Classification Search

CPC ..... G04G 17/04; G04G 21/04; G04G 17/06

See application file for complete search history.

(56) References Cited

U.S. PATENT DOCUMENTS

| | | | | |
|---|---|---|---|---|
| 6,801,476 | B2 | 10/2004 | Gilmour | |
| 6,809,774 | B1 | 10/2004 | Yamazaki et al. | |
| 7,234,010 | B2 | 6/2007 | Gilmour | |
| 2001/0043514 | A1 * | 11/2001 | Kita | G06F 1/163 368/281 |
| 2004/0218474 | A1 | 11/2004 | Yamazaki et al. | |
| 2006/0205364 | A1 | 9/2006 | Chen | |

(Continued)

FOREIGN PATENT DOCUMENTS

| | | | |
|---|---|---|---|
| CN | 1324030 | A | 11/2001 |
| CN | 1832501 | A | 9/2006 |

(Continued)

OTHER PUBLICATIONS

European Search Report dated Mar. 31, 2017.
Chinese Search Report dated Apr. 19, 2017.
Chinese Search Report dated Sep. 27, 2017,

*Primary Examiner* — Gevell Selby
(74) *Attorney, Agent, or Firm* — Cha & Reiter, LLC

(57) ABSTRACT

A wearable electronic device and method of use are disclosed, including a main body, and at least one strap fixed to the main body. The strap includes a core member mounted with at least one electronic component, an electric connector disposed on the core member, and a band member enclosing at least one part of the core member disposed with the electric connector, wherein the at least one electronic component is electrically coupled to the main body through the electric connector.

20 Claims, 45 Drawing Sheets

(56) References Cited

U.S. PATENT DOCUMENTS

| | | | | |
|---|---|---|---|---|
| 2007/0279852 | A1* | 12/2007 | Daniel | G06F 1/163 361/679.03 |
| 2008/0248838 | A1* | 10/2008 | Chiang | G04G 21/04 455/566 |
| 2011/0205851 | A1 | 8/2011 | Harris | |
| 2012/0253485 | A1* | 10/2012 | Weast | G06F 1/163 700/91 |
| 2014/0232980 | A1* | 8/2014 | Harms | G02C 11/00 351/158 |
| 2014/0254083 | A1* | 9/2014 | Wang | G06F 1/1632 361/679.31 |
| 2015/0229813 | A1* | 8/2015 | Isaac-Lowry | H04N 5/2254 348/376 |
| 2015/0261946 | A1* | 9/2015 | Yoon | G06F 21/34 726/19 |
| 2015/0289607 | A1* | 10/2015 | Lee | A44C 5/2076 224/219 |

FOREIGN PATENT DOCUMENTS

| | | | |
|---|---|---|---|
| CN | 202975605 | U | 6/2013 |
| JP | 3988102 | B2 | 7/2007 |
| KR | 1991-0002971 | Y1 | 5/1991 |
| WO | 2005/083546 | A1 | 9/2005 |

* cited by examiner

WEARABLE ELECTRONIC DEVICE WITH ELECTRONIC COMPONENT IN STRAP

CLAIM OF PRIORITY

This application claims priority under 35 U.S.C. § 119 to an application filed in the Korean Intellectual Property Office on Sep. 2, 2013 and assigned Serial No. 10-2013-0105144, the contents of which are incorporated herein by reference.

TECHNICAL FIELD

Various embodiments of the present disclosure relates to a wearable electronic device.

BACKGROUND

Electronic devices perform an increasing number functions while continually being miniaturized, becoming thus both highly portable and very useful. Such electronic devices are generally carried in a pocket of a user, but may also be installed in a wearable device, attachable, for example, to a wrist, head or arm.

Devices wearable on a human body may generally include a main body for executing a function, and a strap affixing the main body to the human body or any other suitable structures. Wearable devices may be used as standalone as subordinate devices, or may be tethered or otherwise subordinate to other electronic devices. When wearable electronic devices are used as subordinate electronic devices, a communication method using a local area network module may be implemented. Due to using wearable electronic devices, it the convenience of other non-wearable electronic devices is reduced. Accordingly, the use of wearable electronic devices is now expanding gradually.

SUMMARY

Various embodiments of the present disclosure provide a strap and a wearable electronic device including the wearable member.

Various embodiments of the present disclosure also provide a wearable electronic device providing reliability although being used for a long time.

Various embodiments of the present disclosure also provide a wearable electronic device configured to utilize a strong coupling structure between a main body and a strap.

Various embodiments of the present disclosure also provide a wearable electronic device capable of strongly coupling electronic components to other structures with a strap.

Various embodiments of the present disclosure also provide a wearable electronic device capable of strongly affixing an electric connector to a strap and simultaneously facilitate mobility.

Various embodiments of the present disclosure also provide a substrate unit configured to electrically couple at least two substrates to one another and a wearable electronic device including the substrate unit.

The various embodiments may provide a wearable electronic device, in which a connector electrically coupling at least two substrates provided in the electronic device are configured to accommodate repeated forward bending, thereby reducing required installation space and allowing more miniaturization of the electronic device.

The wearable electronic device may contain a relatively larger number of signal lines when electrically coupling at least two substrates.

The various embodiments may provide a buckle and a wearable electronic device including the buckle.

The wearable electronic device may partially dispose at least one electronic component on a buckle.

The various embodiments provide an electronic watch including a main body including a display, at least one strap coupled to at least a part of the main body, and a camera module mounted on a part of the at least one strap.

In one aspect of this disclosure, an electronic watch is disclosed, including a main body comprising a display, at least one strap coupled to at least one part of the main body; and at least one camera module mounted on a part of the at least one strap.

In another aspect of this disclosure, a wearable electronic device is disclosed, including a main body comprising a processor, a wearable member coupled to at least one part of the body, and at least one electronic component mounted on a part of the wearable member.

In another aspect of this disclosure, a method of operating an electronic watch is disclosed, the electronic watch including a main body including a display, at least one strap coupled to at least one part of the main body, and at least one camera module mounted on a part of the at least one strap, the method comprising: receiving an image taking command at the main body, transmitting an image obtaining command from the main body to the camera module based on the image taking command, obtaining an image by the camera module, and transmitting the obtained image to the main body.

In another aspect of this disclosure, a method of operating an electronic watch, the electronic watch including a buckle coupled to at least one part of the at least one strap, wherein the buckle includes a speaker electrically coupled with a main body, the method comprising: receiving a sound playback command at the main body, processing sound data to be played back, at the main body, transmitting the processed sound data to the speaker; and replaying a sound by the speaker.

In another aspect of this disclosure, a wearable electronic device is disclosed, including a main body, and at least one strap fixed to the main body, wherein the strap includes: a core member mounted with at least one electronic component, an electric connector disposed on the core member, a band member enclosing at least one part of the core member disposed with the electric connector, wherein the at least one electronic component is electrically coupled to the main body through the electric connector.

In another aspect of this disclosure, a wearable electronic device is disclosed, including a main body, and at least one strap fixed to the main body, wherein the strap includes: a core member, a flexible printed circuit penetrating one surface of the core member and another surface opposite to the one surface and fixed to the both surfaces, a sealing member installed to seal a part of the core member penetrated by the flexible printed circuit, a band member formed using a double injection process to enclose at least one part of the core member disposed with the flexible printed circuit and the sealing member and formed of softer material than the core member, at least one electronic component installed to be electrically coupled to the flexible printed circuit exposed to at least one part of the band member, and a cover mounted to seal an exposed part of the band member mounted with the electronic component.

In another aspect of this disclosure, a wearable electronic device is disclosed, including: a main body, at least one strap fixed to the main body, and a buckle installed on an end of the strap to be fastened to another strap and mounted with at least one electronic component, wherein the buckle comprises: a housing fixed to the end of the strap and mounted with the at least one electronic component, and a fastening unit disposed on an outer surface of the housing and fastened to the another strap.

In another aspect of this disclosure, a wearable electronic device is disclosed, including: a main body, at least one strap fixed to the main body, a housing installed on an end of the strap and having a unit containing space therein, at least one electronic component contained in the unit containing space of the housing, a cover for sealing the unit containing space, at least one sealing member disposed between the cover and the unit containing space for sealing the unit containing space, and at least one band fixing pole protruding from an outer surface of the cover and correspondingly inserted into at least one opening formed on another strap.

In another aspect of this disclosure, a wearable electronic device is disclosed, including: a main body, at least one strap fixed to the main body, and a buckle fixed to an end of the strap to be fastened to another strap and mounted with at least one electronic component, wherein the strap comprises: a core member mounted with at least one electronic component, an electric connector disposed on the core member, a band member coupled with the core member to enclose at least one part of the core member disposed with the electric connector, wherein the at least one electronic component is electrically coupled to the main body through the electric connector, and wherein the buckle comprises: a housing fixed to the end of the strap and mounted with the at least one electronic component, and a fastening unit disposed on an outer surface of the housing and fastened to the another strap.

BRIEF DESCRIPTION OF THE DRAWINGS

The present disclosure will become more apparent from the following detailed description when taken in conjunction with the accompanying drawings in which.

DETAILED DESCRIPTION

Figure 1:
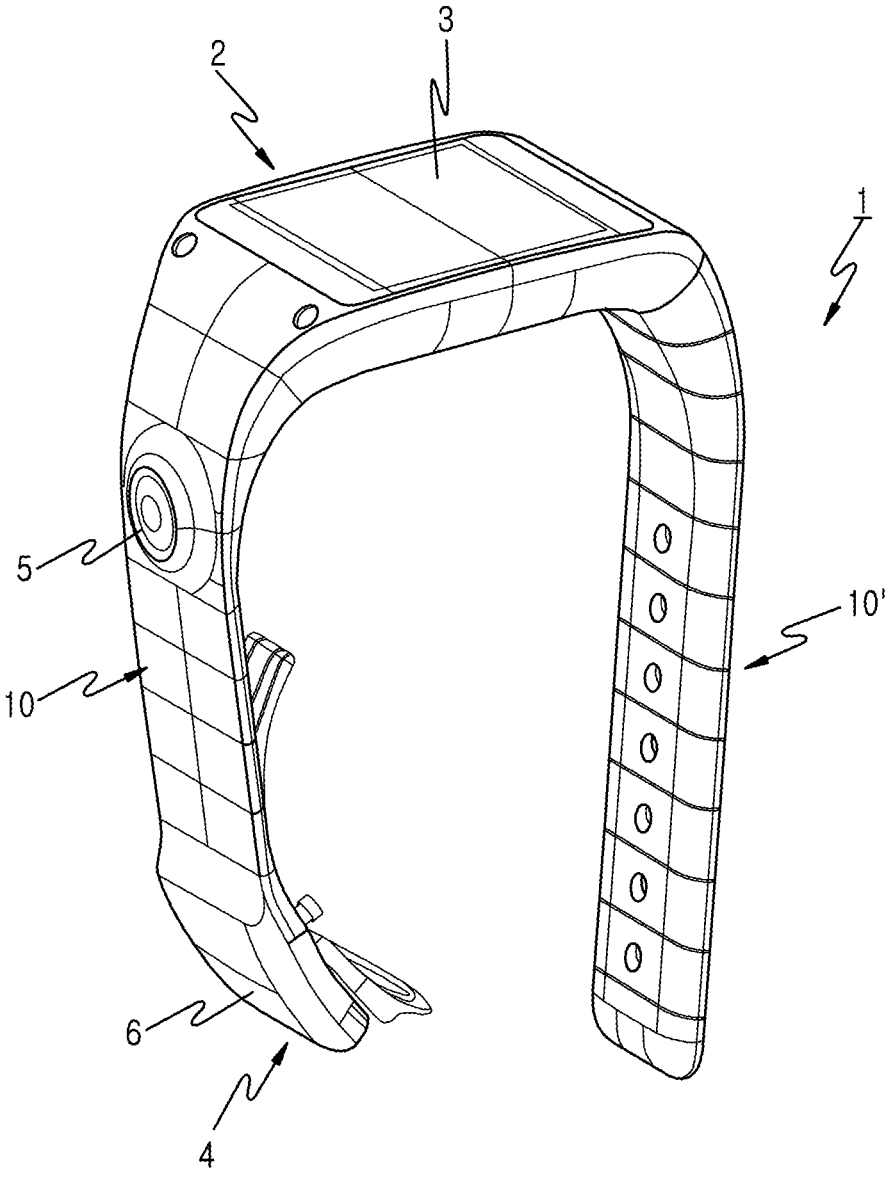
FIG. 1 is a perspective view of an example wearable electronic device according to embodiments of the present disclosure.

Hereinafter, various embodiments of the present disclosure will be described in detail with reference to the attached drawings. While describing the present disclosure, when it is determined that a detailed description of well-known typical functions or configurations may make the points of the present disclosure unclear, the detailed description will be omitted. Also, terms described below are defined considering functions thereof in the embodiments, which may vary with a user, an intention of an operator, or a preferred practice. Accordingly, definitions thereof when given, are given with reference to the content of the entire specification.

In describing the various embodiments of the present disclosure, a wearable electronic device may include a main body and at least one strap combined with the main body.

In describing various embodiments of the present disclosure, the wearable electronic device may be applied to various devices, mounted on a human body or mounted on a suitable structure via the strap. According to various embodiments, the wearable electronic device may be affixed to various portions of a human body such as a wrist, an arm, a head part, etc. However, the wearable electronic device is not limited thereto, but may also be affixed to various devices and structure by the strap.

Electronic devices may include various wearable electronic devices that are independently utilizable, or utilizable when coupled to other electronic devices. In one embodiment, the wearable electronic device may be coupled to another electronic device, communicating therewith using a communication module. In this case, the wearable electronic device may output information to another electronic device, receive and vicariously output information outputted by still another electronic device, and may output information together with yet another electronic device. All these processes may be performed simultaneously. According to one embodiment, the information may be visually outputted through a display unit, acoustically outputted through a speaker, or tactually outputted through vibrations. According to one embodiment, the communication module may be a local area network (LAN) module. According to one embodiment, the LAN module may be at least one of a WiFi communication module, a Bluetooth communication module, an infrared communication module, or a near field communications (NFC) module.

Various embodiments of the present disclosure are described in relation to a wearable electronic device, but may also be applied to various general devices, to which the strap is applicable, in addition to electronic devices.

Various embodiments of the present disclosure may provide at least two substrates mutually folded by a connector. According to the embodiment, a configuration described above may be applied to the main body of the wearable electronic device. However, it is not limited thereto, and may be applied to various electronic devices, to which at least two substrates are separately applied, such as personal digital assistants (PDA), a laptop computer, a mobile phone, a smart phone, a netbook, a mobile Internet device (MID), an ultra mobile personal computer (PC, UMPC), a tablet PC, a navigation, an MP3, an electronic watch, etc.

In describing various embodiments of the present disclosure, the wearable electronic device may be applied to various devices including a main body, at least one strap combined with the main body, and a buckle provided on an end of the at least one strap.

Various embodiments of the present disclosure are described in relation to a wearable electronic device but may be applied to various general devices including the strap and the buckle applied to an end of the strap, according to the embodiment, in addition to electronic devices.

Various embodiments of the present disclosure, according to description, may be described as a wearable member, a strap, and a connection body. The terms mean the same component having a structure fixing the main body to an external object and containing at least one electronic component, and may be mutually interchangeable.

Hereinafter, various embodiments of the present disclosure will be described.

FIG. 1 is a perspective view of a wearable electronic device 1 according to embodiments of the present disclosure. According to the various embodiments, a watch-type electronic device wearable on a wrist of a human body will be described.

The wearable electronic device 1 may include a main body 2 and straps 10 and 10' fixed to both ends of the main body, respectively. The strap in some embodiments may be formed as one piece, being coupled from one end of the main body 2 to the other end without break or separation. Similarly, the strap, when as a plurality of sections, may form two or more separate strap ends, such as the straps 10 and 10'. In FIG. 1, for convenience of description, a pair of straps 10 and 10' are illustrated as an example.

The main body 2 may be equipped with a display unit 3, and at least one of the straps 10 or 10' may be equipped with electronic components to enable execution of functions of the wearable electronic device 1. In one embodiment, the display unit 3 may be equipped with a touch screen unit capable of inputting and outputting data. The electronic components may also include at least one of a camera 5 or a speaker 6. The camera 5, for example, may be installed on, for example, a middle part of the strap, separate from the main body 2 and distanced at a certain interval. The speaker 6 may be installed on an end of the strap. Although not shown in the drawings, various other devices, such as a microphone, an antenna, and a sensor for sensing an environmental condition or a state of a human body and may be included in the wearable electronic device 1.

In one embodiment, a buckle 4 may be installed on an end of the strap 10. For example, when allowing the main body 2 to be put on a wrist, the pair of straps 10 and 10' are turned inwards, following the contour of the wrist. As such, when the ends of the straps 10 and 10' meet, the buckle 4 of the strap 10 is fastened to the strap 10', thereby affixing the wearable electronic device 1 to the wrist. In one embodiment, the wearable electronic device 1 may connect the two straps 10 and 10' to each other by fastening the buckle 4 installed on the strap 10 to at least one of a plurality of openings formed on the strap 10'.

According to the various embodiments, the pair of straps 10 and 10' are fixed to both ends of the main body 2 to be opposite to each other. However, the straps 10 and 10' are not limited to this variation. For example, one strap may be installed on one side of the main body 2 with a length sufficient to fully enclose the wrist and then affix itself to the other end of the main body 2.

According to the various embodiments, the straps 10 and 10' may be formed using multiple materials each having different degrees of softness. In one embodiment, the straps 10 and 10' are manufactured using a first material having a first softness as a core member (11 of FIG. 2) and a second material having second softness as a band member (13 of FIG. 2), the second material at least partially enclosing the core member 11. In one embodiment, the first softness may be smaller than the second softness. Hereinafter, the core member 11 may be referred as a first member and the band member 13 may be referred as a second member.

According to the various embodiments, since the band member 13 has a relatively high degree of softness, it has its own elasticity and is capable of being formed into the external shape of the straps 10 and 10,' thereby providing a user with excellent wearability. It also allows the wearable electronic device 1 to be affixed to various devices via an available bending range. At least one of urethane, silicone, rubber, thermoplastic polyurethane (TPU), or thermoplastic silicone vulcanizate (TPSiV) may be used a material for the band member 13.

According to the various embodiments, a member having relatively lesser degree of softness may be to form the core member 11, which may be formed of a more rigid material. In one embodiment, the straps 10 and 10' are manufactured such that the band member 13 partially encloses the core member 11, and may be further configured to expose parts to which the electronic components may be attached. In one embodiment, since the electronic components are mounted on the exposed parts of the core member 11, and the core member 11 is formed of the rigid material, the electronic components may be more firmly secured. This improves operational reliability of the wearable electronic device 1. In one embodiment, the core member 11 may be formed of a resin material such as polycarbonate (PC) or Grilamid TR90. In one embodiment, the core member 11 may be formed of metal. In one embodiment, the core member may be formed of any one of stainless steel or aluminum.

Hereinafter, a configuration of the strap 10 of the wearable electronic device 1 will be described in detail. The other strap 10' may, in some embodiments, have the same or similar configuration.

Figure 2:
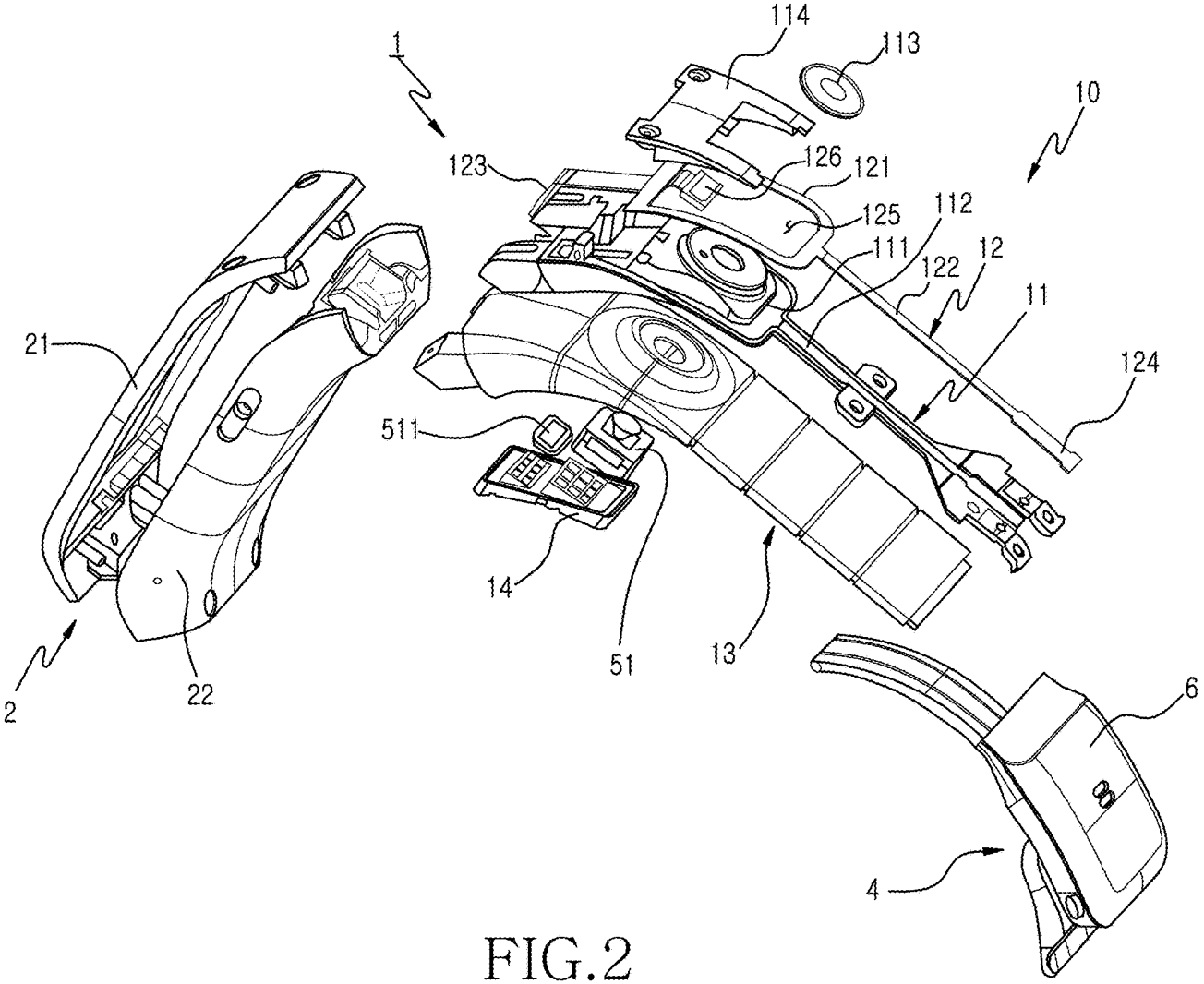
FIG. 2 is a separate perspective view of an example wearable electronic device.

FIG. 2 is a separate perspective view of the wearable electronic device 1.

Referring to FIG. 2, according to the various embodiments, the main body 2 includes an upper case frame 21 and a lower case frame 22, which may be assembled with each other using an additional fastening structure. In one embodiment, the main body 2 may provide a containing space by assembling the upper case frame 21 with the lower case frame 22. In the containing space, various electronic components such as a substrate unit (23 of FIG. 13) may be installed. In one embodiment, the upper case frame 21 and the lower case frame 22 may be coupled with each other using their own respective built-in locking structures thereof. In one embodiment, the upper case frame 21 and the lower case frame 22 may be assembled with each other using an additional external fastening element, such as a threaded fastener. Hereinafter, the substrate unit 23 installed on the main body 2 will be described in detail.

According to the various embodiments, the strap 10 may include the core member 11, a flexible printed circuit (FPC) 12 installed on the core member 11 to be used as an electric connection element, and the band member 13 disposed to enclose at least one part of the core member 11 attached with the FPC 12 and forming an external shape of the strap 10. In one embodiment, the strap 10 may further include a camera module 51 installed on the core member 11, through the band member 13, and electrically coupled to the FPC 12, a cover 14 used as a finishing material after mounting the camera module 51, and the speaker 6 electrically coupled to a third connector 124 exposed on the end of the band member 13 and disposed on the buckle 4.

According to the various embodiments, the core member 11 include a core body 111 and a core extension 112, which extends from the core body 111. The core body 111 has relatively greater width than the core extension 112. The camera module 51 may be mounted on the core body 111. Since flection is stronger applied the farther one is removed from the main body 2 along the strap 10, the core member 11 formed of the rigid material may be gradually narrow in width as it extends toward the core extension 112. In one embodiment, the core body 111 may be further equipped with a reinforced washer 113 to prevent deformation of the desired shape while being injection molded with the band member 13. In one embodiment, the reinforced washer 113 may be formed of a metallic material and may possess a lens penetration hole (1131 of FIG. 3A), allowing light to pass through to the lens during capture of a picture. In one embodiment, the reinforced washer 113 may be fixed to the core body 111 using an insert-molding process while mold manufacturing the core member 11.

According to the various embodiments, the FPC 12 may include a circuit body 121 formed to have a shape corresponding to the core body 111 of the core member 11 to be attached thereto, and a circuit extension 122 extended from the circuit body 121 with a particular length that is attached to the core extension 112.

According to the various embodiments, the FPC 12 may include a first connector 123 extending from the circuit body 121 in a direction opposite to the circuit extension 122, and protruding outwards of the band member 13 while finally manufacturing the band member 13. The first connector 123 may be inserted into the main body 2 while the strap 10 is coupled with the main body 2, and may be electrically coupled to the main body 2.

According to the various embodiments, the circuit body 121 may have a hollow 125, and may include a second connector 126 protruding into the hollow 125. When the circuit body 121 is attached to the core body 111, the second connector 126 may be disposed to penetrate a rear (119 of FIG. 3B) of the core body 111. In one embodiment, the second connector 126 penetrates the core body 111 of the core member 11 and is exposed to the rear (119 of FIG. 3B) and may be electrically coupled to a camera connector 511 of the camera module 51.

According to the various embodiments, the third connector 124 may be further installed on an end of the circuit extension 122. When the band member 13 is manufactured to enclose the core member 11, the third connector 124 may be exposed outwards and electrically coupled to the speaker 6 disposed on the buckle 4.

According to the various embodiments, the cover 14 is installed on a rear 103 (refer to FIG. 6B) of the band member 13 to secure the camera module 51 mounted on the core member 11 through the band member 13. But actually, the cover 14 may be coupled with the core member 11. In one embodiment, the cover 14 may be formed of the same material as the band member 13 to provide an identical texture and an identical plane of an outer surface of the band member 13 while being coupled with the core member 11. In one embodiment, the cover 14 may be formed of the same material as the core member 11.

According to the various embodiments, a sealing member 114 may be disposed on a top of the core body 111. In one embodiment, the sealing member 114 may be disposed to seal a part penetrated by the second connector 126 of the FPC 12. In one embodiment, the sealing member 114 may be assembled being injection molded by the band member 13 while being assembled with the core body 111 attached with the FPC 12.

Hereinafter, respective members will be described in detail.

Figure 3A:
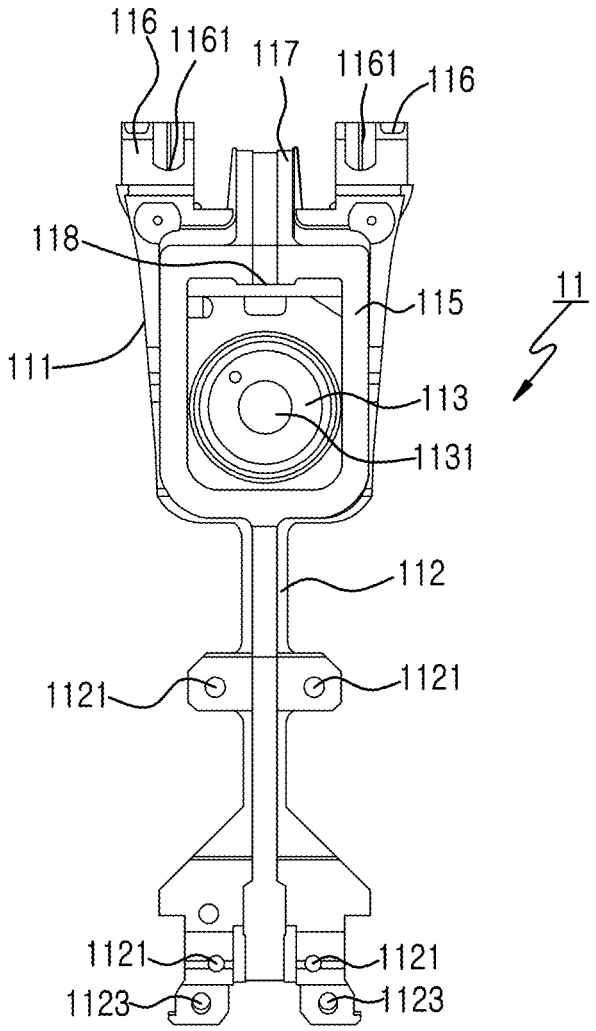
FIG. 3A and FIG. 3B are a top view and a rear view of an example core member according to embodiments of the present disclosure.
Figure 3B:
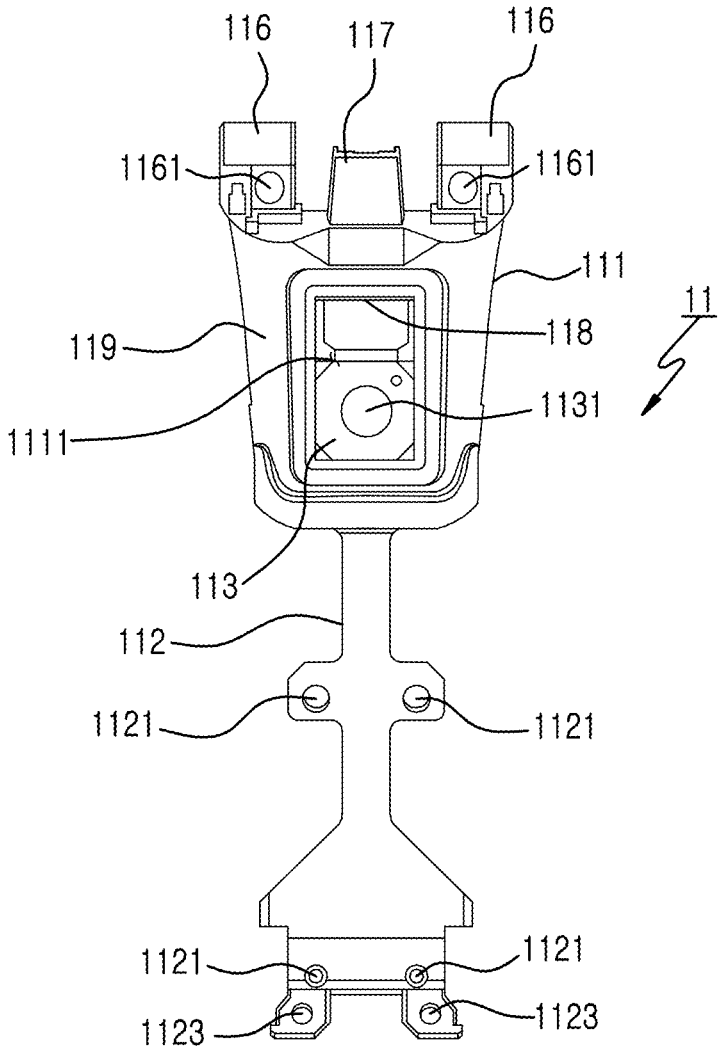

FIGS. 3A and 3B are a top view and a rear view of the core member 11.

Referring to FIG. 3A, the core member 11 may include the core body 111 for containing the camera module 51 (not shown). The core member 11 may have a relatively greater width than the core extension 112, which extends from the core body 111 out to a certain length, and possesses a relatively smaller width. In one embodiment, the core body 111 and the core extension 112 may be formed as a single body. As described above, the core body 111 is provided with the reinforced washer 113 formed of a metallic material and insert-molded together with injecting the core body 111, thereby preventing any deformation from transpiring when the band member 13 is injected to the core body 111, or when the strap 10 is fixed to the main body 2 and bent, thereby preventing deformation resulting from an external force applied to the camera module 51.

According to the various embodiments, a pair of main body connection protrusions 116 protruding upwards with a certain interval may be formed on the core body 111. The main body connection protrusions 116 may be provided with fixation holes 1161. In one embodiment, the main body connection protrusions 116 may be assembled to penetrate protrusion penetration holes 223 (refer to FIG. 8A) formed on the lower case frame 22 (refer to FIG. 8A) and the fixation holes 1161 may be exposed in the protrusion penetration holes 223. Herein, insertion protrusions 211 (refer to FIG. 8B) formed on the upper case frame 21 are inserted into the fixation holes 1161, thereby strongly securing the main body connection protrusions 116 to the main body 2, due the assembly of the upper and lower case frames 21 and 22 (of FIG. 2). The coupling described above will be described in further detail below.

According to the various embodiments a circuit supporting protrusion 117 is formed between the pair of main body connection protrusions 116. The circuit supporting protrusion 117 may support a part from the circuit body 121 (of FIG. 4A) to the first connector 123 (of FIG. 4A) of the FPC 12. In one embodiment, the circuit supporting protrusion 117 may be injected being mostly enclosed by the band member 13 except the first connector 123.

According to the various embodiments, at least one circuit penetration hole 118 may be formed on the core body 111, penetrating the second connector 126 of the FPC 12 attached to a front 115 of the core member 11, and may be located on a unit installation space 1111 (of FIG. 3B) of the rear 119 (of FIG. 3B) of the core member 11.

According to the various embodiments, the core extension 112 may be formed with a plurality of supporting holes 1121. In one embodiment, the plurality of supporting holes 1121 may prevent a movement of the core member 11 and may allow the band member 13 to be strongly injected to the core member 11 while double injection molding the band member 13.

According to the various embodiments, at least one penetration opening 1123 may be formed on an end of the core extension 112. In one embodiment, the penetration opening 1123 may be used as a penetration opening for mechanical coupling when the end of the core extension 112 is inserted into a housing of the buckle 4 (from FIG. 2).

Referring to FIG. 3B, the unit installation space 1111 may be formed on the rear 119 of the core member 11 to allow the camera module 51 (of FIG. 2) to be installed. In one embodiment, the second connector 126 (of FIG. 2) may be disposed on the unit installation space 1111 to be inserted from the front 115 of the core member 11 and exposed.

Figure 4A:
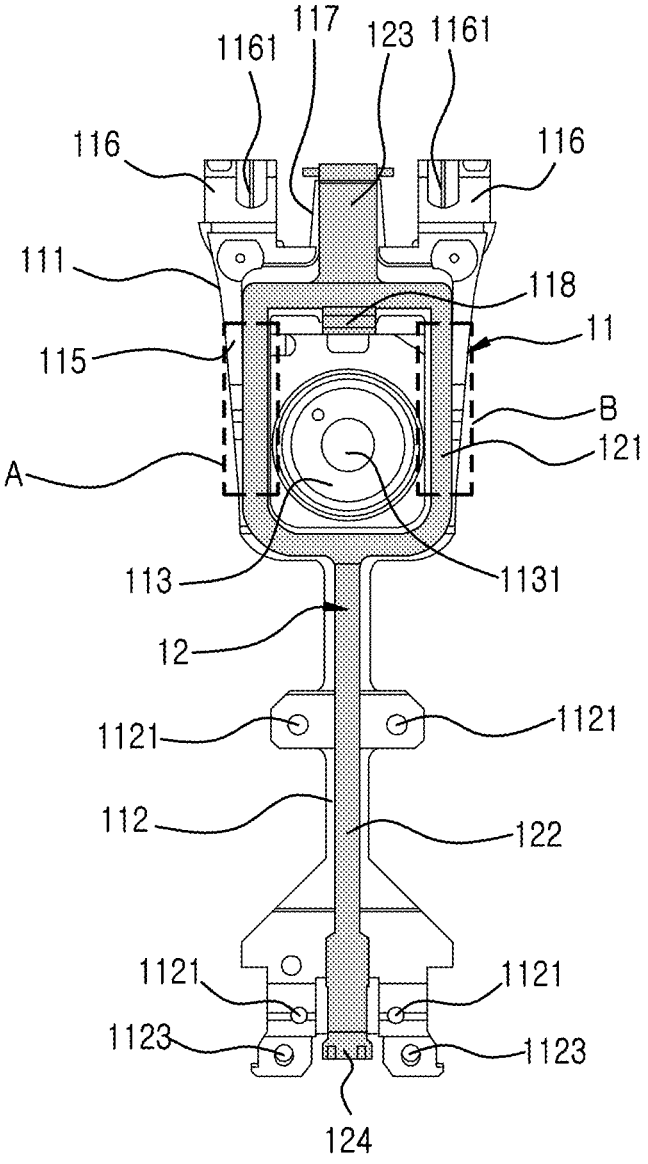
FIG. 4A and FIG. 4B are a top view and a rear view of an example core member attached with a flexible printed circuit (FPC) according to embodiments of the present disclosure.
Figure 4B:
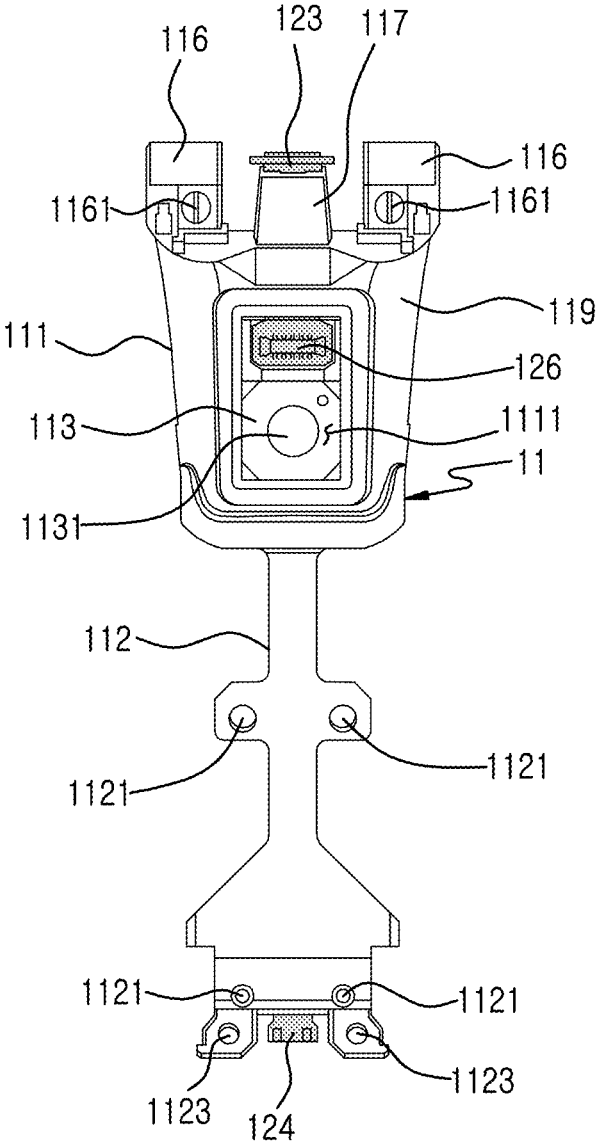

FIGS. 4A and 4B are a top view and a rear view of the core member 11 attached with the FPC 12, respectively.

Referring to FIGS. 4A and 4B, the FPC 12 may be attached and fixed to the front 115 of the core member 11. The circuit body 121 of the FPC 12 is attached to the core body 111 of the core member 11, and the circuit extension 122 may be attached to the core extension 112 corresponding thereto. In one embodiment, the FPC 12 may be attached to the core member 11 using a double-sided tape. In one embodiment, the FPC 12 may be bonded to the core member 11 using additional adhesives.

According to the various embodiments, from the circuit body 121 of the FPC 12 to the first connector 123 extended upwards may be attached and fixed to the circuit supporting protrusion 117 of the core member 11. In one embodiment, the circuit extension 122 and the core extension 112 may be formed to have substantially identical lengths.

According to the various embodiments, the second connector 126 may be disposed in the unit installation space 1111 formed on the rear 119 of the core member 11 while being exposed. The second connector 126 may also be attached and fixed to a proper position of the unit installation space 1111.

According to the various embodiments, at least one antenna emitter may be formed as a pattern on a part of the circuit body 121 of the FPC 12 attached to the core body 111. In one embodiment, the antenna emitter may be disposed on a part A and/or a part B, as shown in FIG. 4A. In one embodiment, the antenna emitter may be disposed in various locations electrically coupleable to the FPC 12, in addition to the parts A and B. In one embodiment, the antenna emitter may be an LAN antenna emitter for communication between the wearable electronic device 1 and other electronic devices. In one embodiment, the antenna emitter may be at least one of a Bluetooth communication antenna emitter, WiFi communication antenna emitter, or an NFC antenna emitter.

Figure 5A:
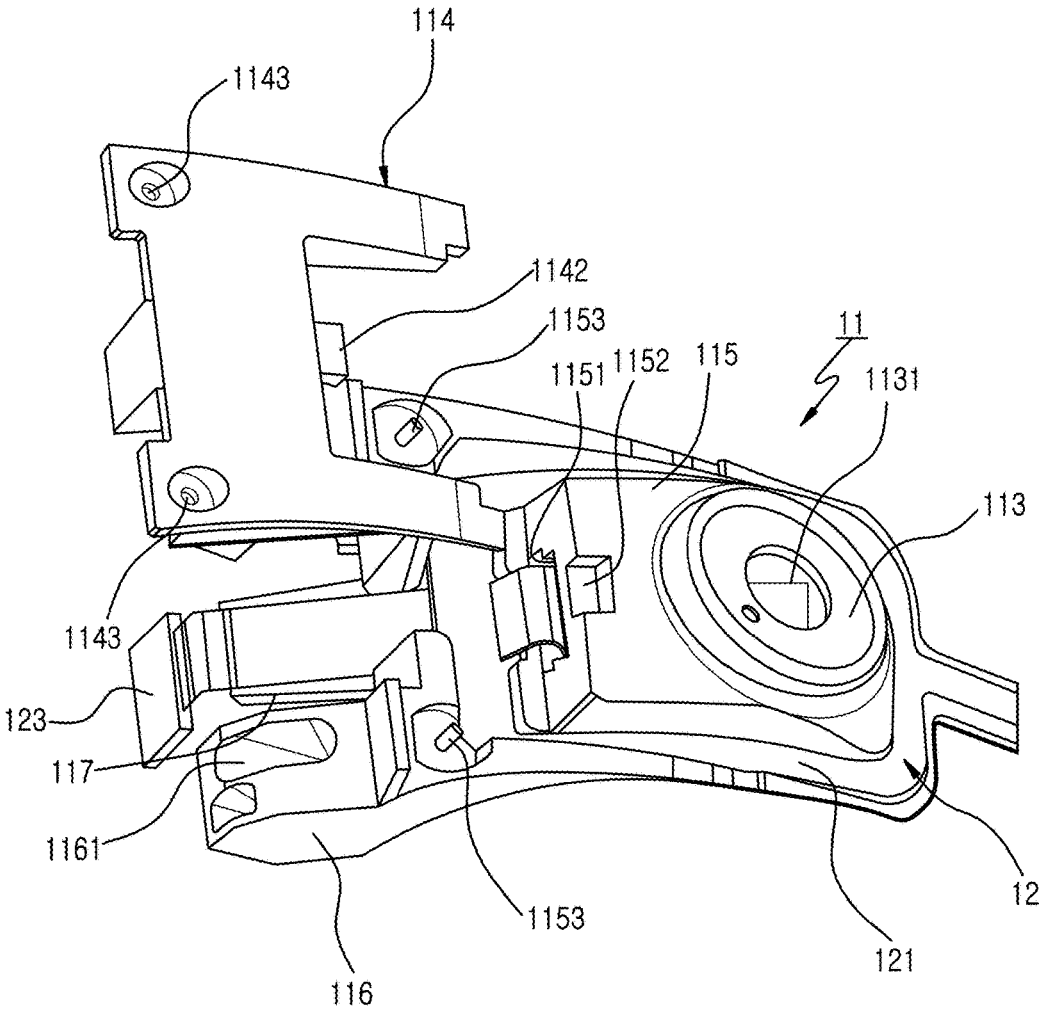
FIG. 5A and FIG. 5B are a separate perspective view and a combination view illustrating an example state in which a sealing member is installed in the core member according to embodiments of the present disclosure.
Figure 5B:
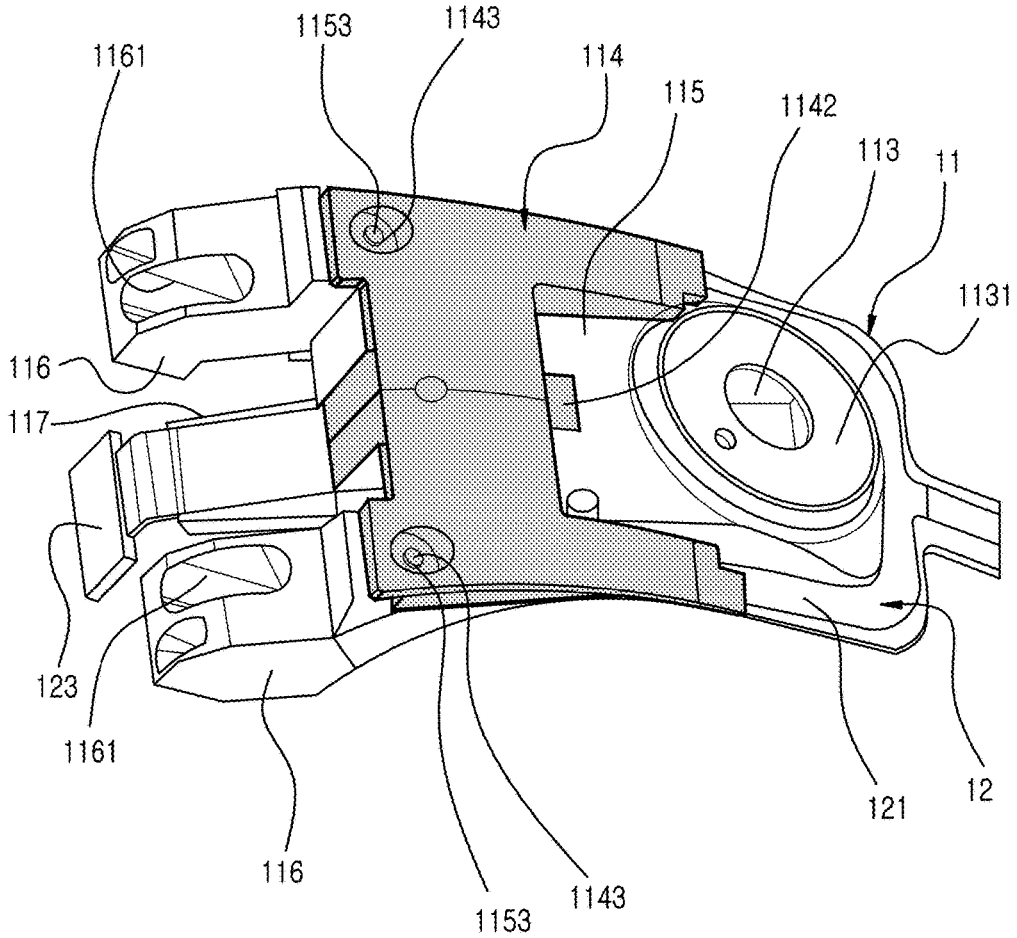

FIGS. 5A and 5B are a separate perspective view and a combination view illustrating an example state, in which the sealing member 114 is installed in the core member 11 according to embodiments of the present disclosure.

Referring to FIGS. 5A and 5B, the sealing member 114 may be further installed on the top of the core member 11 attached with the FPC 12. In one embodiment, the sealing member 114 may be attached to the top of the core body 111 already coupled with the circuit body 121. In one embodiment, the sealing member 114 may be installed to seal one or more circuit penetration holes 1151 or 1152 formed in the core body 111 of the core member 11. This will be very useful while double injection molding the band member 13 from the core body 111.

According to the various embodiments, the band member 13 is attached with the FPC 12, primarily injecting the front 115 of the core member 11 while coupling the sealing member 114 with a top thereof, and secondarily injecting the rear 119 of the primarily injected core member 11, thereby completely forming a member, that is, the strap. In this case, the sealing member 114 may prevent injection materials from flowing into an opposite side, that is, the unit installation space 1111 formed in the rear 119 of the core member 11 through the circuit penetration holes 1151 and 1152 formed in the core body 111 while primarily injecting or secondarily injecting.

According to the various embodiments, the sealing member 114 may be mounted on the front 115 of the core body 111 in a manner of being deposited. In one embodiment, the sealing member 114 may be formed with at least one sealing protrusion 1142 and may seal the one or more corresponding circuit penetration holes 1151 or 1152 formed in the core body 111, thereby preventing a leakage of injection materials while doubly injecting.

According to the various embodiments, the sealing member 114 is formed with at least one assembling hole 1143, and a corresponding position of the core body 111 may be formed with at least one assembling protrusion 1153 to be inserted into the assembling hole 1143. However, it is not limited thereto. The core body 111 may be formed with at least one assembling hole, and the sealing member 114 may be formed with at least one assembling protrusion. The assembling protrusion 1153 and the assembling hole 1143 may be fixed to one another using a forcible insertion method or may be assembled by allowing the assembling protrusion 1153 to be mounted on or to penetrate the assembling hole 1143.

According to the various embodiments, the sealing member 114 may prevent the leakage of injection materials from a first side to a second side of the core member 11 while doubly injecting the band member 13 simultaneously with reinforcing rigidity for allowing the camera module 51 installed on the core member 11 to stably perform operations.

Figure 6A:
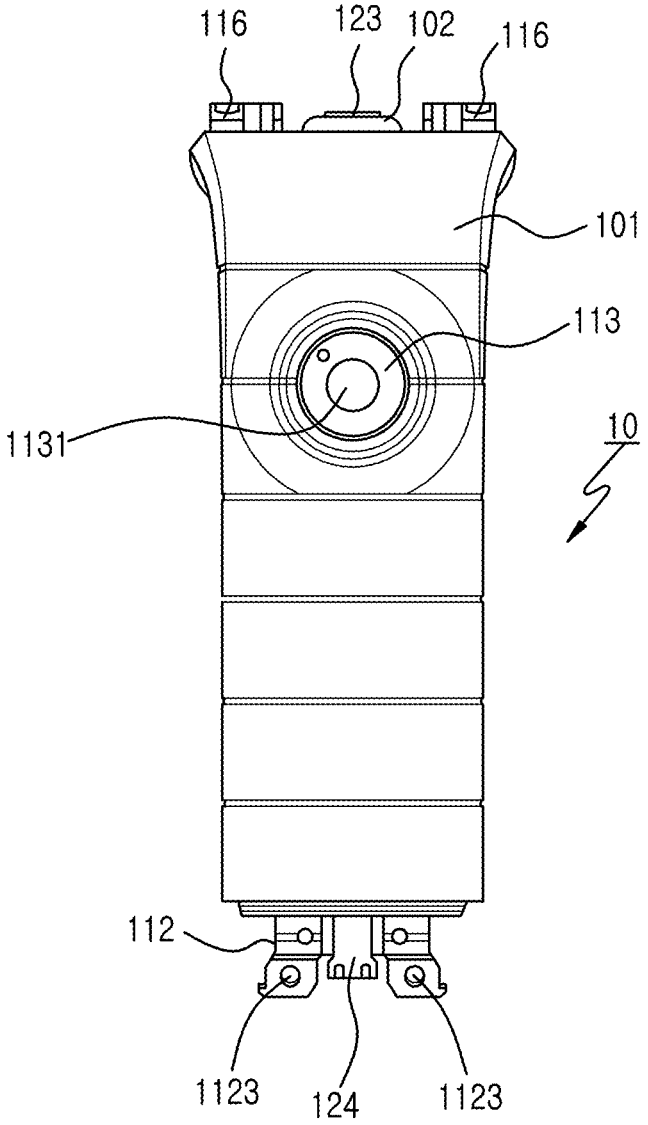
FIG. 6A and FIG. 6B are a top view and a rear view of an example band member injected after applying the FPC and the sealing member to the core member according to embodiments of the present disclosure.
Figure 6B:
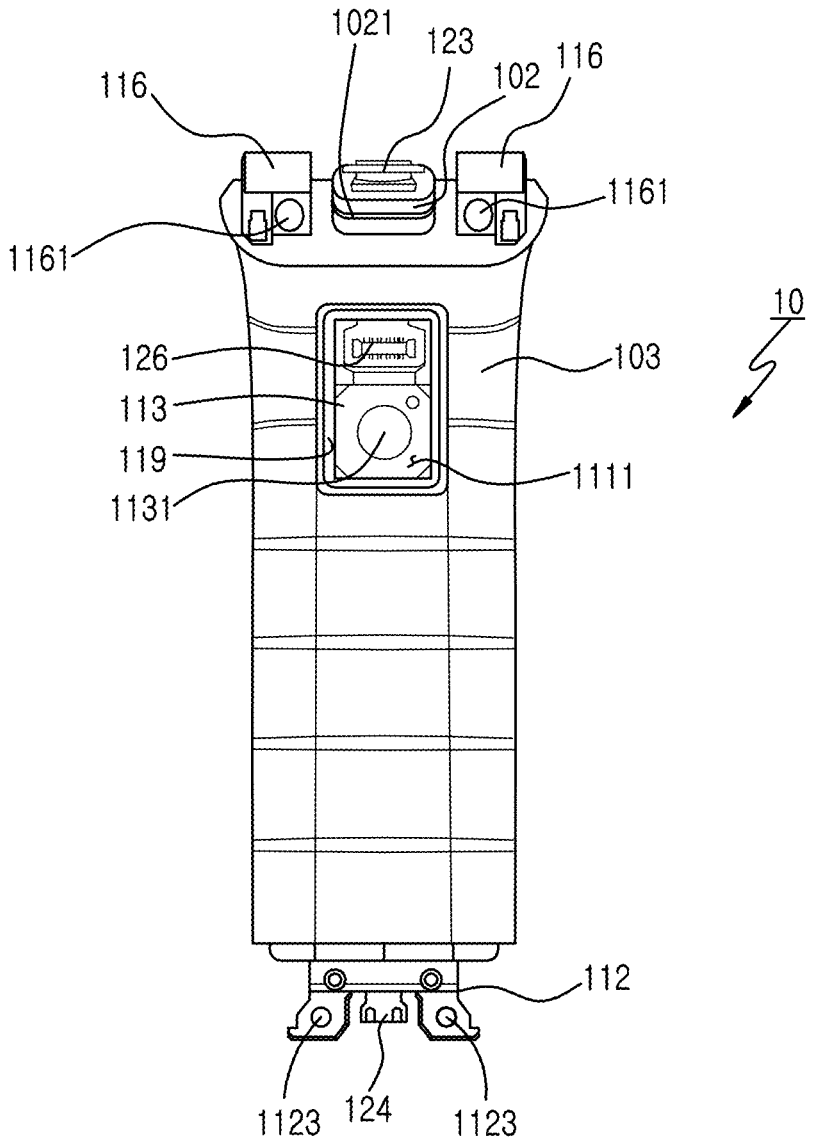

FIGS. 6A and 6B are a top view and a rear view of the band member 10 injected after applying the FPC 12 and the sealing member 114 to the core member 11 according to embodiments of the present disclosure.

Referring to FIGS. 6A and 6B, the band member 10 having softer materials than the core member 11 may be formed to enclose the core member 11. The band member 10 may be formed by using a double injection method of primarily injecting the front 115 of the core member 11 and secondarily injecting the rear 119 of the core member 10 as a single band member 10.

According to the various embodiments, the band member 10 may be injected in a manner of exposing at least one part of the core member 11. In one embodiment, the band member 10 may be injected in a manner of exposing the main body connection protrusion 116 of the core member 11. In one embodiment, the band member 10 may be injected to expose the unit installation space 1111 and a part of the rear 119 of the core member 11 forming the unit installation space 1111 toward the rear 103. In one embodiment, the band member 10 may be injected in a manner of exposing the core extension 112 of the core member 11. In one embodiment, the band member 10 may be injected to expose at least connectors 123, 124, and 126 of the FPC 12 mounted on the core member 11. In one embodiment, the band member 10 may be injected to expose corresponding parts of the core member 11 supporting the first connector 123, second connector 126, and third connector 124 of the FPC 12. In one embodiment, the band member 10 may be formed to expose the reinforced washer 113 and a part of the front 115 (from FIGS. 4A-5B) of the core member 11 supporting the reinforced washer 113 on the front 101.

According to the various embodiments, the first connector 123 of the FPC 12 may be inserted into the main body 2 and electrically coupled to the substrate unit 23 disposed on the main body 2, the second connector 126 may be disposed in the middle of the strap to be exposed and may be coupled to the camera module 51, and the third connector 124 may be exposed on an end together with the core extension 112 and may be electrically connected to the speaker 6 disposed on the buckle 4.

According to the various embodiments, as shown in FIG. 6B, between the pair of main body connection protrusions 116 exposed from the band member 10, a circuit guide protrusion 102 may be formed. The circuit guide protrusion 102 may be injected to be extended from the band member 10 in a manner of enclosing all the circuit supporting protrusion 117 of the core member 11 and the FPC 12 attached thereto, except the first connector 123. The circuit guide protrusion 102 may further include a ring-shaped protrusion 1021 formed to protrude along an outer circumferential surface. In one embodiment, the circuit guide protrusion 102 including the ring-shaped protrusion 1021 may be closely inserted into a guide protrusion mounting groove 221 (refer to FIG. 8C) of the main body 2 using a forcible insertion method. Accordingly, the ring-shaped protrusion 1021 may prevent an inflow of water or impurities toward the main body 2 through the guide protrusion mounting groove 221. It is because all the circuit guide protrusion 102 including the ring-shaped protrusion 1021 is formed of an elastic material identical to the band member 10, for example, urethane.

Figure 7:
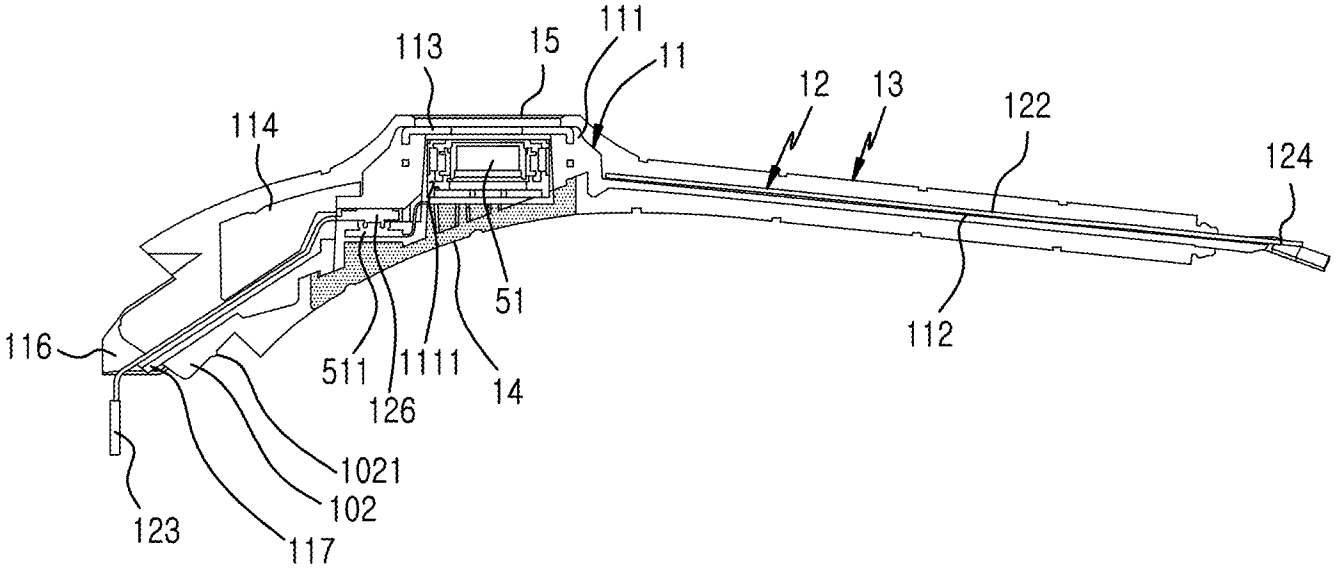
FIG. 7 is a cross-sectional view of an example strap according to embodiments of the present disclosure.
Figure 8A:
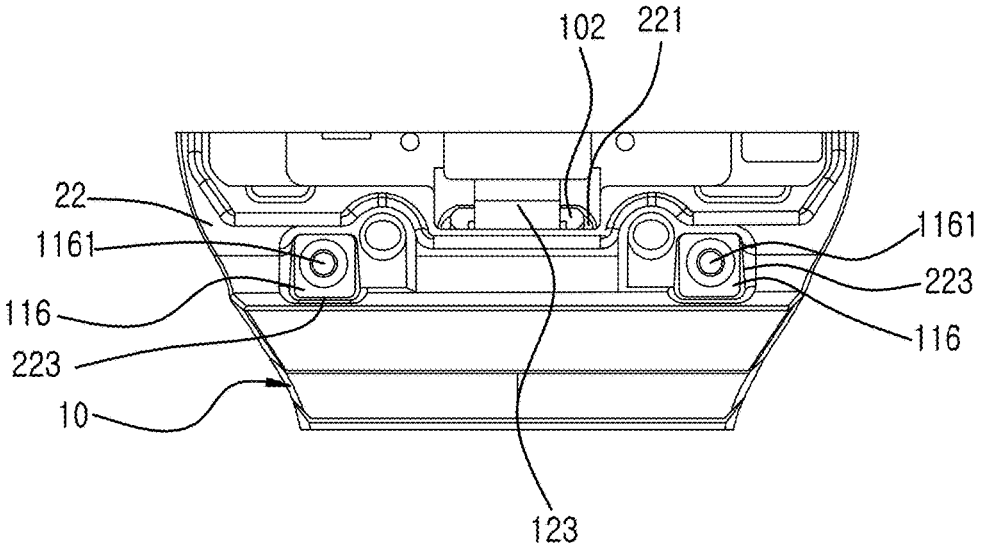
FIG. 8A, FIG. 8B and FIG. 8C are diagrams illustrating an example combination structure between the strap and the main body of the wearable electronic device according to embodiments of the present disclosure.
Figure 8B:
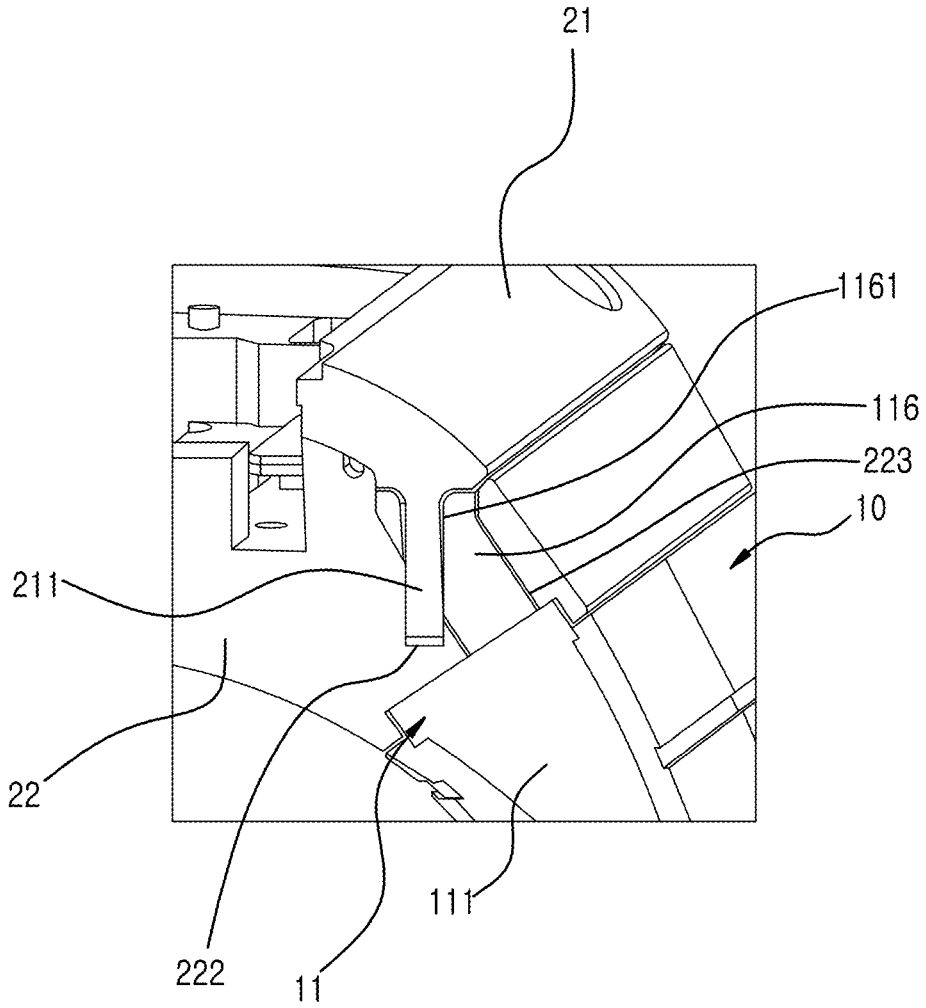
Figure 8C:
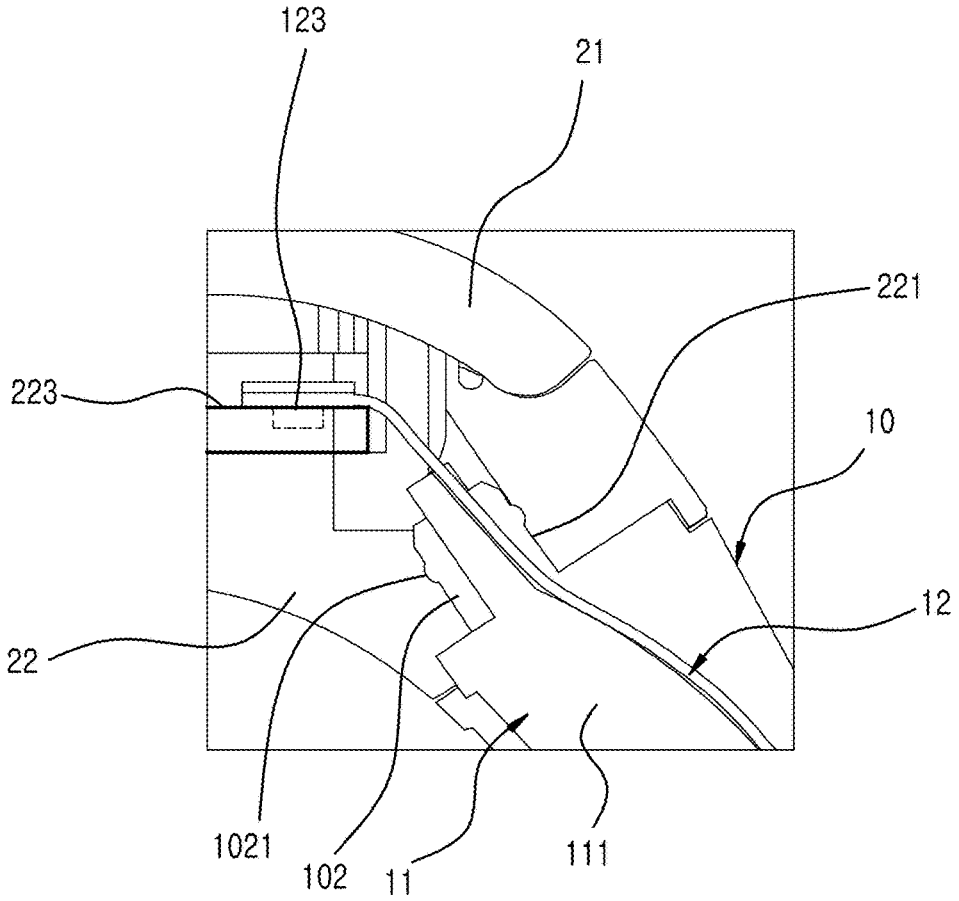

FIG. 7 is a cross-sectional view of the strap 10 according to various embodiments of the present disclosure. FIGS. 8A to 8C are diagrams illustrating a combination structure between the strap 10 and the main body 2 of the wearable electronic device 1 according to embodiments of the present disclosure.

Referring to FIG. 7, the strap 10 may include the core member 11 and the band member 13 double injection molding the FPC 12 attached to the core member 11, thereby substantially defining an external shape. In one embodiment, the band member 13 may expose the reinforced washer 113 insert-injected to the front of the core member 11. In one embodiment, the band member 13 may expose the unit installation space 1111 formed on the rear 119 of the core member 11 and an edge of the core member 11 forming the unit installation space 1111. In one embodiment, the band member 13 may also expose the second connector 126 of the FPC 12, protruding from the front 115 (from FIGS. 4A-5B) of the core member 11 to the unit installation space 1111 through a circuit penetration hole 1151. In one embodiment, the band member 13 may also expose the third connector 124 formed on the end of the core extension 112 of the core member 11 and the circuit extension 122 of the FPC 12 attached to the core extension 112.

According to the various embodiments, the camera module 51 may be contained in the unit installation space 1111 disposed on the rear 119 of the band member 13. Herein, the camera connector 511 of the camera module 51 may be electrically coupled to the second connector 126 of the FPC 12 exposed to the unit installation space 1111. In one embodiment, after the camera module 51 is mounted, the unit installation space 1111 may be finished by the cover 14. In one embodiment, the cover 14 may be fixed to the core member 11 exposed through the unit installation space 1111. In one embodiment, the cover 14 may be formed of the same material as the core member 11. In one embodiment, the cover 14 may be formed of the same material as the band member 13. In one embodiment, when being mounted on the unit installation space 1111, the cover 14 may be waterproof. In one embodiment, when being mounted on the unit installation space 1111, the cover 14 may be installed at least not to protrude from the rear 103 of the band member 13.

According to the various embodiments, a camera window 15 formed of a transparent material may be installed on a top of the reinforced washer 113. In one embodiment, the camera window 15 may be attached and fixed to the reinforced washer 113. In one embodiment, the camera window 15 may be attached and fixed to the band member 13 with a certain interval from the reinforced washer 113. In one embodiment, the camera window 15 may be attached to the band member 13 while being waterproofed. In one embodiment, the camera window 15 may be formed of one of a synthetic resin material and a glass material.

As shown in FIGS. 8A and 8B, the pair of main body connection protrusions 116 protruding from the band member 13 may be assembled penetrating the protrusion penetration holes 223 formed in the lower case frame 22 of the main body 2. In one embodiment, the fixation holes 1161 of the main body connection protrusions 116 may be exposed and disposed in the protrusion penetration holes 223. In one embodiment, when the upper case frame 21 of the main body 2 is fixed to the lower case frame 22, the insertion protrusions 211 protruding from corresponding positions of the upper case frame 21 are mounted on and fixed to the fixation holes 1161 of the main body connection protrusions 116. In one embodiment, the insertion protrusions 211 of the upper case frame 21 may penetrate the fixation holes 1161 of the main body connection protrusions 116 and may be mounted on mounting grooves 222 formed on the lower case frame 22.

According to the various embodiments, the main body connection protrusions 116 are extended from the core member 11 are excluded, and additional members having the same shape as the main body connection protrusions 116 may be injected to the core member 11 using an insert molding method while injecting the core member 11. In this case, the main body connection protrusions 116 may be formed of an additional metallic material.

According to the various embodiments, the insertion protrusions 211 formed on the upper case frame 21 are excluded and screw holes are formed on the upper case frame 21, thereby fixing from the screw holes of the upper case frame 21 to the mounting grooves 222 of the lower case frame 22 through the fixation holes 1161 of the main body connection protrusions 116 by mechanical fastening. In this case, additional metallic members having a screw-fastening opening and performing the same function as the main body connection protrusions 116 may be injected being insert-molded to the core member 11.

As shown in FIG. 8C, the pair of main body connection protrusions 116 protruding from the band member 13 penetrate the protrusion penetration holes 223 of the lower case frame 22, and the circuit guide protrusion 102 of the band member 13 is also mounted on the guide protrusion mounting groove 221 formed on the lower case frame 22 of the main body 2 at the same time. In one embodiment, the protrusion penetration holes 223 of the lower case frame 22 for containing the main body connection protrusions 116 are isolated from an inner space of the main body 2 to be waterproof, dustproof, and antifouling. However, the guide protrusion mounting groove 221 of the lower case frame 22 for containing the circuit guide protrusion 102 is coupled to the inner space of the main body 2. This is because the circuit guide protrusion 102 supports the first connector 123 of the FPC 12 and the first connector 123 is inserted into and electrically coupled to the inner space of the main body 2. In one embodiment, the first connector 123 may be electrically coupled to a substrate inside the main body 2.

According to the various embodiments, the circuit guide protrusion 102 is formed extending the band member 13, and the ring-shaped protrusion 1021 may protrude along an outer circumferential surface. Accordingly, when the circuit guide protrusion 102 is mounted on the guide protrusion mounting groove 221 of the lower case frame 22, the ring-shaped protrusion 1021 is forcibly inserted into an inner circumferential surface of the guide protrusion mounting groove 221 so as to be waterproof. In one embodiment, the circuit guide protrusion 102 and the ring-shaped protrusion 1021 are formed by extending and injecting the band member 13 having relatively softer materials, thereby maximizing a waterproof function.

In one embodiment, the strap 10 may be bent with a certain curvature, in which the FPC 12 located within may be supported by the core member 11, thereby preventing disconnection or deformation.

In the various embodiments, the core member 11 having relatively more rigid materials doubly injected into the band member 13 is fixed to the main body 2, thereby strongly fixing the strap 10 to the main body 2. In one embodiment, although used for a long time, reliability of the wearable electronic device 1 may be provided.

According to the various embodiments, at least one part of the core member 11 mounted with the FPC 12 electrically coupled to the main body 2 is exposed to a proper position of the band member 13 and various electronic components are installed to be separate from the main body 2 in corresponding areas, thereby preventing an increase in a volume of the main body 2 and preventing a limitation in design of the wearable electronic device 1.

Figure 9:
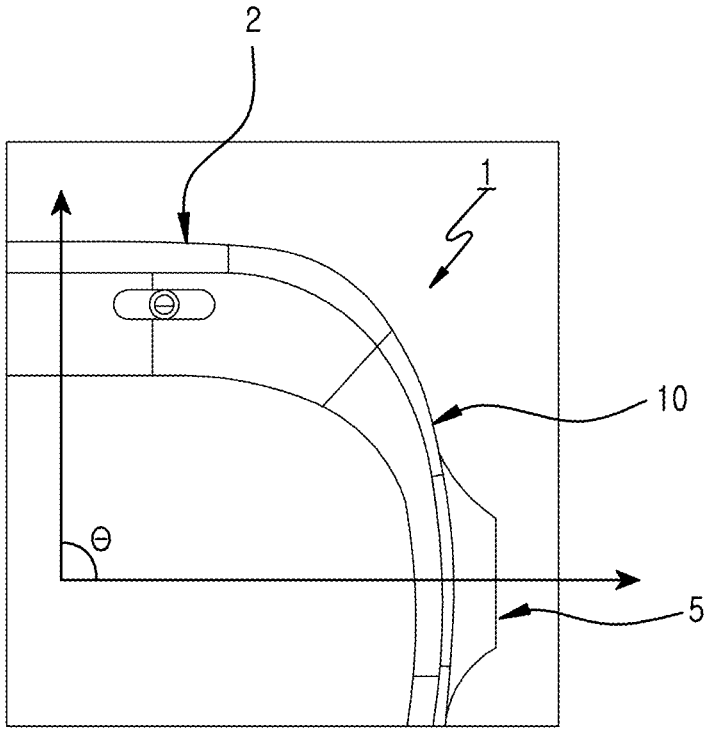
FIG. 9 is a diagram illustrating an example angle at which the strap is fixed to the main body according to embodiments of the present disclosure.

FIG. 9 is a diagram illustrating an angle at which the straps 10 and 10' are fixed to the main body 2 according to embodiments of the present disclosure.

Referring to FIG. 9, the wearable electronic device 1 may include the main body 2 and the straps 10 and 10' coupled to both sides of the main body 2, respectively. Herein, the straps 10 and 10' may include a strap 10 extended in the left of the body of a wearer when the wearable electronic device 1 is worn on a wrist, for example, installed to be extended upwards from the display unit 3 and a strap 10' extended toward the body of the wearer, for example, installed to be extended downwards from the display unit 3. In one embodiment, the camera 5 may be installed on the strap 10. In one embodiment, the camera 5 is installed on the strap 10 and may be disposed in a location for easily taking a picture of an object in an outer direction.

According to the various embodiments, the strap 10 may be installed on the main body 2 to allow an extension angle θ formed by a plane of the display unit 3 and the camera window 15 of the camera 5 to have a range from about 60° to about 120°. In one embodiment, the strap 10 may be installed to be at an angle of about 90° with the main body 2.

Figure 10A:
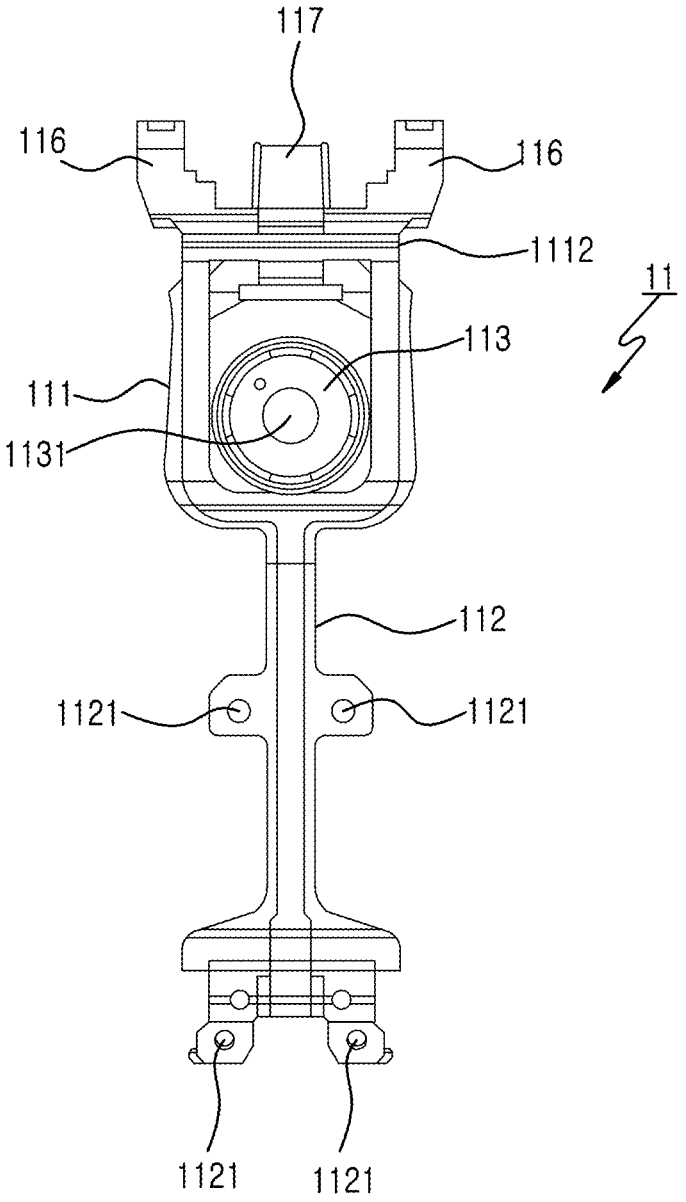
FIG. 10A and FIG. 10B are diagrams illustrating an example configuration of the core member according to embodiments of the present disclosure.
Figure 10B:
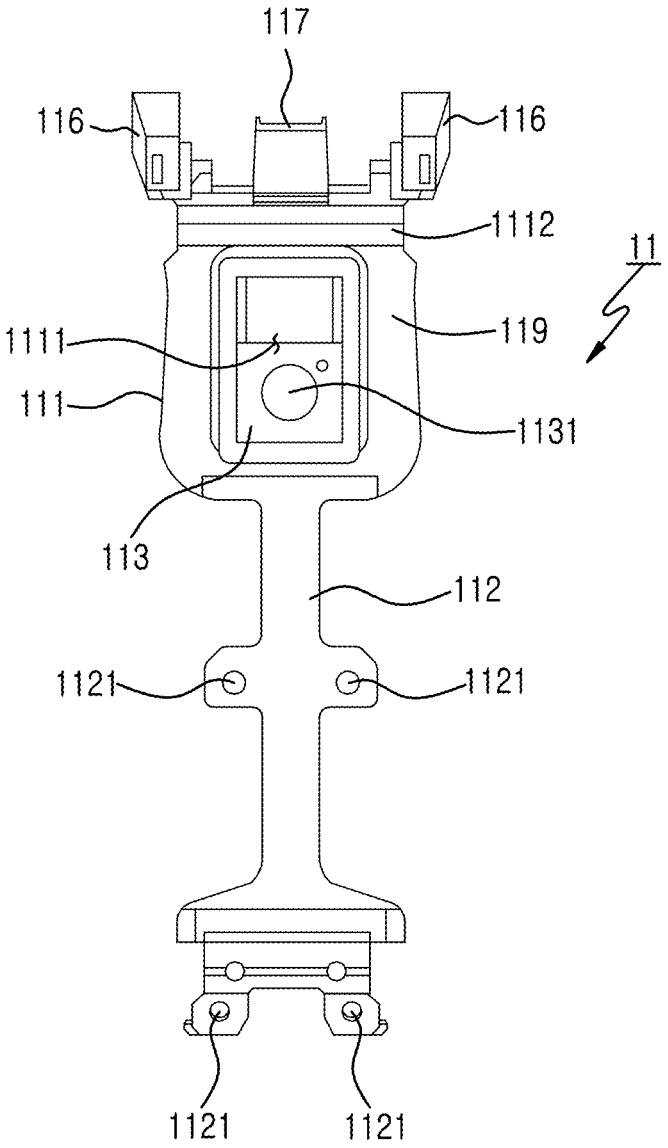

FIGS. 10A to 10B are diagrams illustrating a configuration of the core member 11 according to the various embodiments of the present disclosure.

Referring to FIGS. 10A and 10B, the core member 11 may include the core body 111 including the unit installation space 1111 installed with the camera module 51 as an electronic component, the core extension 112 extended from the core body 111, and the main body connection protrusion 116 extending from the core body 111 in a direction of mounting the main body 2.

According to the various embodiments, a core recess 1112 may be formed in a part in which the main body connection protrusions 116 and the core body 111 are coupled to one another. In one embodiment, the core recess 1112 may be formed in a part of the strap, coupled to the main body 2 and receiving a greatest external force. In one embodiment, the core recess 1112 may be formed from a part started with a connection with the main body 2 to the core body 111 installed with electronic components. In one embodiment, the core recess 1112 may be formed in a direction in which a thickness of the core member 11 becomes smaller, in a manner of slimming. In one embodiment, the core recess 1112 may be formed in a direction in which the thickness of the core member 11 becomes smaller and may be formed to be curved. However, the core recess 1112 is not limited thereto and may be formed as various shapes instead of a curve.

According to the various embodiments, the core recess 1112 is formed on the core member 11, thereby providing all various users having differently sized wrists with excellent wearability while wearing the wearable electronic device 1 on the wrists using the straps 10 and 10'.

Figure 11A:
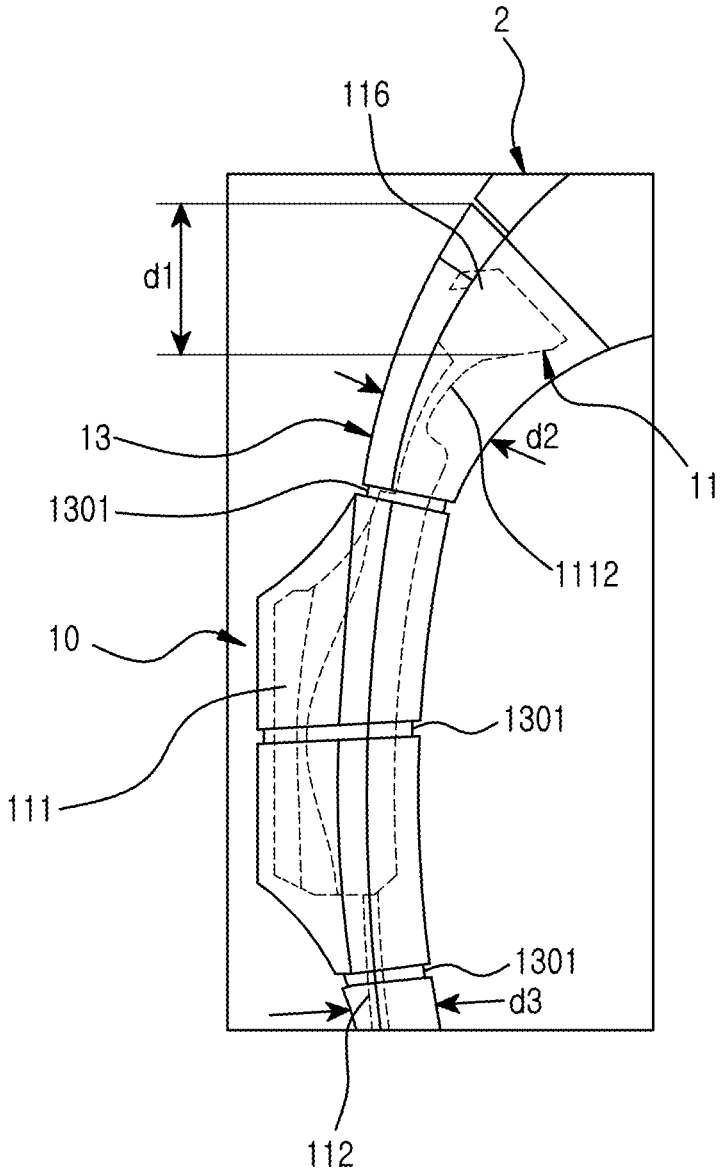
FIG. 11A and FIG. 11B are diagrams illustrating an example configuration of the core member and the band member for improving wearability according to embodiments of the present disclosure.
Figure 11B:
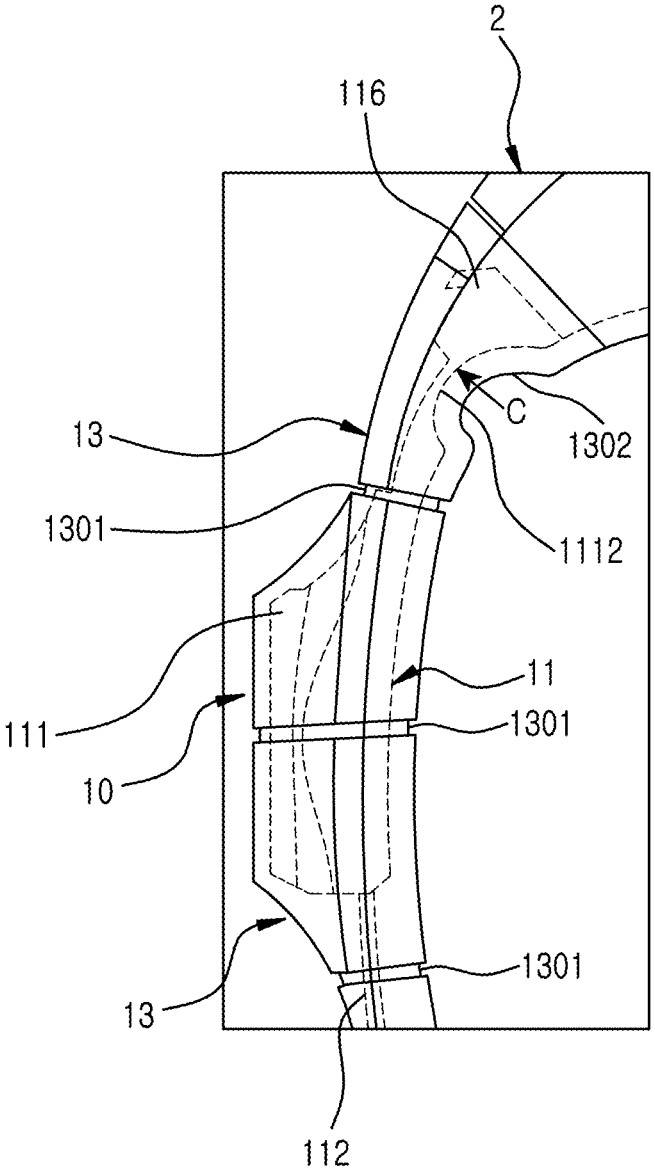

FIGS. 11A and 11B are diagrams illustrating a configuration of the core member 11 and the band member 13 for improving wearability according to embodiments of the present disclosure.

Referring to FIG. 11A, the strap 10 may be configured by doubly injecting the band member 13 to the core member 11 formed with the core recess 1112. In one embodiment, the core recess 1112 may start from a section d1 of the strap 10, starting connection with the main body 2 and including the main body connection protrusions 116. In one embodiment, the core recess 1112 may be formed from a part started with the main body connection protrusions 116 to the core body 111 mounted with the electronic components of the strap 10.

According to the various embodiments, a thickness d2 of the strap 10 in a part formed with the core recess 1112 may be formed to be relatively more reduced than an existing thickness. In one embodiment, a difference between the thickness d2 of the part of the strap 10, receiving the greatest external force, and a thickness d3 of other parts of the band member 13 corresponding to the core extension 112 may be determined within a range of about 10%. In one embodiment, the thickness d2 may be greater than or identical to the thickness of the section d1.

Referring to FIG. 11B, a part C of the strap 10, receiving a greatest force, may also be formed with a band recess 1302 on the band member 13 in the same manner of the core recess 1112. However, the band recess 1302 is not limited thereto and may be formed as a different shape from the core recess 1112.

In one embodiment, the band recess 1302 may be formed to allow an outer surface of the band member 13 and an outer surface of the core member 11 to have the same length when the band recess 1302 is formed as the same shape as the core recess 1112. In one embodiment, the band recess 1301 may be formed not to allow the outer surface of the band member 13 and the outer surface of the core member 11 to have the same length.

In one embodiment, the band recess 1302 is formed to be curved toward the core member 11 but is not limited thereto. For example, the band recess 1302 is formed in a slimming manner toward the core member 11 but may be formed as various shapes instead of a curve. In one embodiment, the band member 13 may be formed with grooves along the outer surface with a certain interval to support flexibility of the strap 10.

Figure 12A:
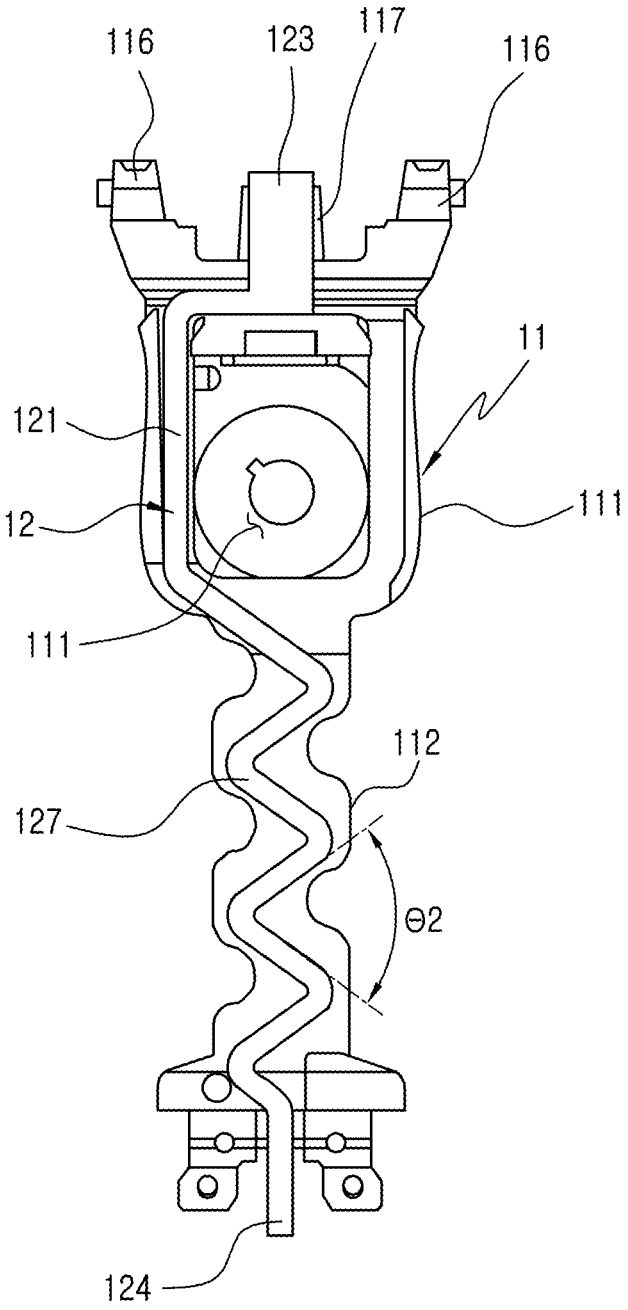
FIG. 12A, FIG. 12B and FIG. 12C are diagrams illustrating an example configuration, in which an electric connector is applied to the core member according to embodiments of the present disclosure.
Figure 12B:
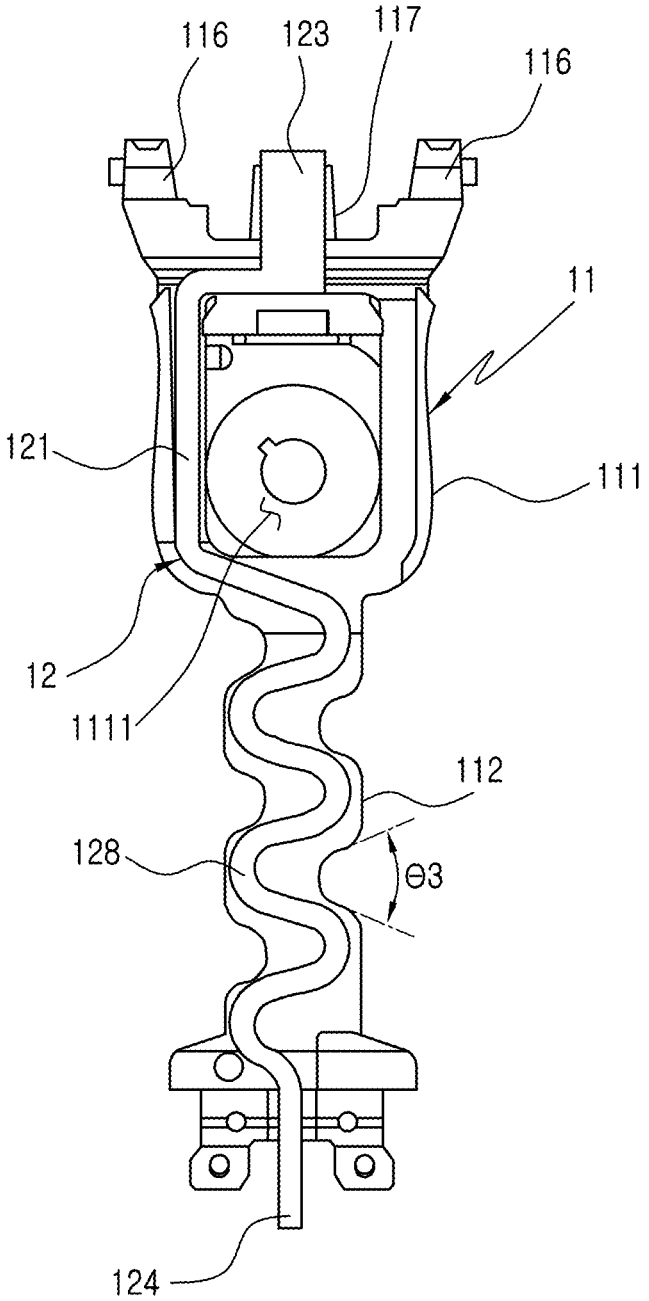
Figure 12C:
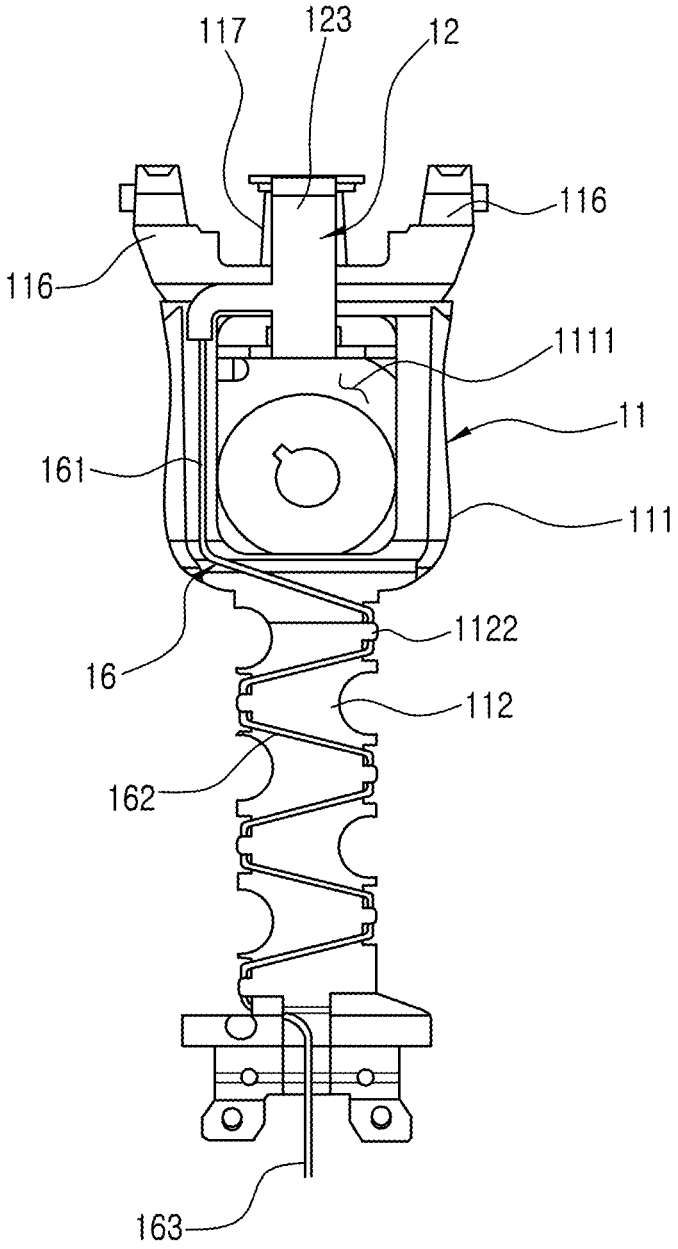

FIGS. 12A to 12C are diagrams illustrating a configuration, in which an electric connector is applied to the core member 11 according to embodiments of the present disclosure.

In the present drawings, the components of the core member 11 and the FPC 12 are designated with reference numerals, and may not be described for convenience and brevity of description. However, the components perform the same functions as the corollary preceding components having the same reference numerals.

Referring to FIGS. 12A and 12B, the core member 11 may include the core body 111 installed with electronic components and the core extension 112 extended from the core body 111. In one embodiment, the FPC 12 may be disposed on the core body 111 one or one and another side of the core member 11 as the electric coupler having a substantially corresponding to the shape of the core member 11.

According to the various embodiments, when the band member 13 is injected to the core member 11 and operates as the strap 10, the core body 111 is less bent but relatively more bent toward the core extension 112. Accordingly, the core extension 112 may be bent in considerably various directions while wearing or separating the wearable electronic device 1 on or from the wrist. In one embodiment, due to bending of the core extension 112, circuit extensions 127 and 128 of the FPC 12 disposed on a top thereof may also be bent together. For example, the circuit extensions 127 and 128 and the core extension 112 may not be fixed to the inside of the injected band member 13. Accordingly, an external force is applied to the circuit extensions 127 and 128 due to bending of the core extension 112, and mechanical fatigue may be accumulated due to being frequently bent, thereby causing disconnections and malfunctions.

According to the various embodiments, the circuit extensions 127 and 128 may be formed in a zigzag shape. In one embodiment, the circuit extensions 127 and 128 formed in the zigzag shape may provide additional length to compensate for bending of the core extension 112.

According to the various embodiments, angles of the zigzag shape of the circuit extensions 127 and 128 may be formed to have a range of from about 25 to about 80 degrees. In one embodiment, the circuit extensions 127 and 128 may be formed to be alternately extended in opposite directions with an angle of about 40 degrees. In one embodiment, a zigzag angle θ2 of the circuit extension 127 is 70 degrees and alternately extended in FIG. 12A, and a zigzag angle θ3 of the circuit extension 128 is 40 degrees and alternately extended in FIG. 12B.

In one embodiment, as shown in FIG. 12C, the FPC 12 and a thin cable 16 may be applied together as electric connectors. In one embodiment, the FPC 12 may be extended from the circuit supporting protrusion 117 of the core member 11 to the core body 111 and the thin cable 16 is also alternately extended in different directions in a zigzag shape from the core body 111 to the core extension 112 to a fourth connector 163. In one embodiment, the thin cable 16 may include a cable body 161 disposed on the core body 111 and a cable extension 162 extended to the core extension 112. In one embodiment, the cable extension 162 of the thin cable 16 may be guided by hung on a plurality of supporting protrusions 1122 protruding from the core extension 112 with certain intervals.

According to the various embodiments, an electric connector such as the FPC 12 or the thin cable 16 may head for the core extension 112 while detouring to the unit installation space 1111 of the core body 111 in either sides or one side.

According to the various embodiments, the core extension 112 supporting one of the circuit extensions 127 and 128 and the cable extension 162 may be formed corresponding to the zigzag shape of the circuit extensions 127 and 128 and the cable extension 162 or may be formed as another shape thereto.

Figure 13:
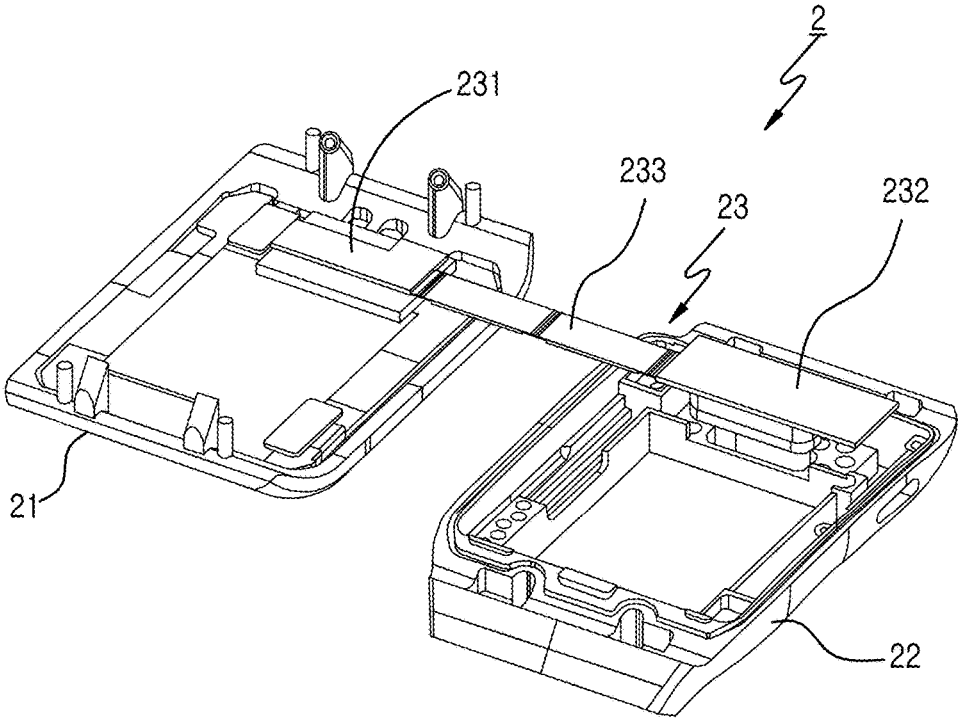
FIG. 13 is a separate perspective view illustrating an example state, in which a substrate is installed in the main body of the wearable electronic device according to embodiments of the present disclosure.

FIG. 13 is a separate perspective view illustrating a state, in which a substrate is installed in the main body 2 of the wearable electronic device 1.

Referring to FIG. 13, the main body 2 may include the upper case frame 21 and the lower case frame 22. In one embodiment, the upper case frame 21 and the lower case frame 22 may be coupled with each other using an own locking structure or using a fastening unit such as a screw. In one embodiment, the substrate unit 23 for containing a plurality of electronic components, that is, an electronic function group may be installed in the space formed by the upper case frame 21 and the lower case frame 22.

According to the various embodiments, as the substrate unit 23, a first substrate 231 may be installed on the upper case frame 21 and a second substrate 232 may be installed on the lower case frame 22. In one embodiment, the first substrate 231 may be used as a main substrate mounted with a liquid crystal display (LCD) module for the display unit 3 of the main body 2 and a touch sensor. In one embodiment, the second substrate 232 may include a pogo connector mounted on the main body 2 to expose a pogo pin to charge a battery and transmit and receive data and a terminal connector for containing the first connector 123 of the FPC 12 withdrawn from the strap.

According to the various embodiments, the first substrate 231 and the second substrate 232 may be electrically coupled to each other using a connector 233 having a certain length. In one embodiment, the connector 233 may be disposed inside the main body 2 while being bent and overlapped with a certain interval. In one embodiment, the first substrate 231 and the second substrate 232 may be disposed in locations perpendicularly separate from each other but overlapped with each other by the connector 233 disposed being a plurality of times folded.

Figure 14:
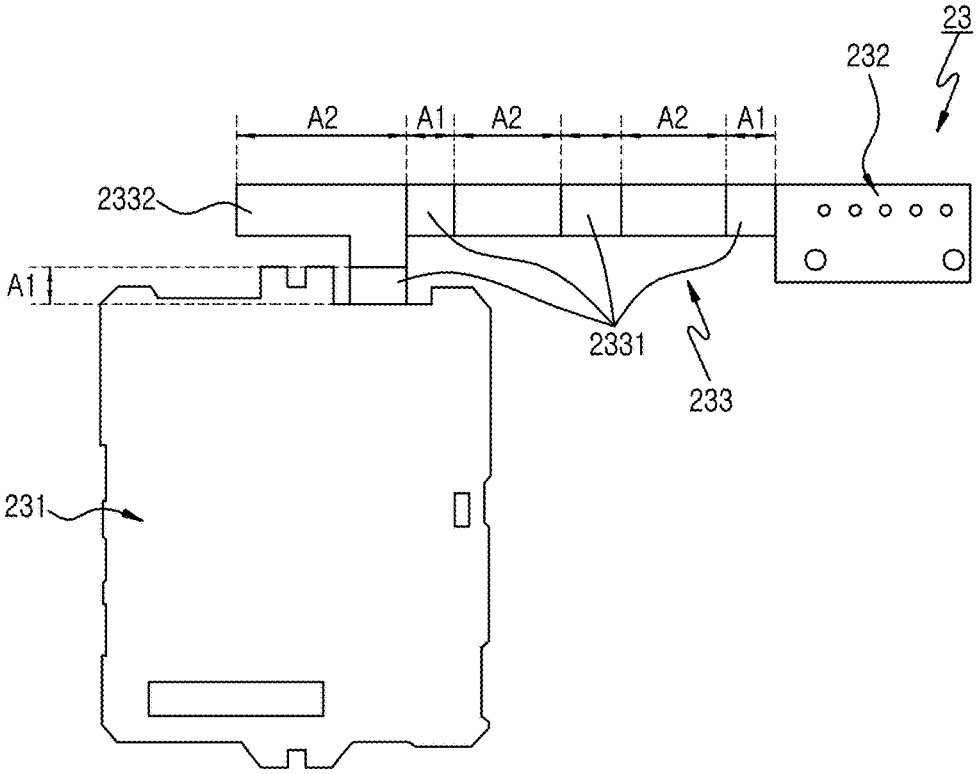
FIG. 14 is a configuration view of an example substrate applied to the wearable electronic device according to embodiments of the present disclosure.
Figure 15:
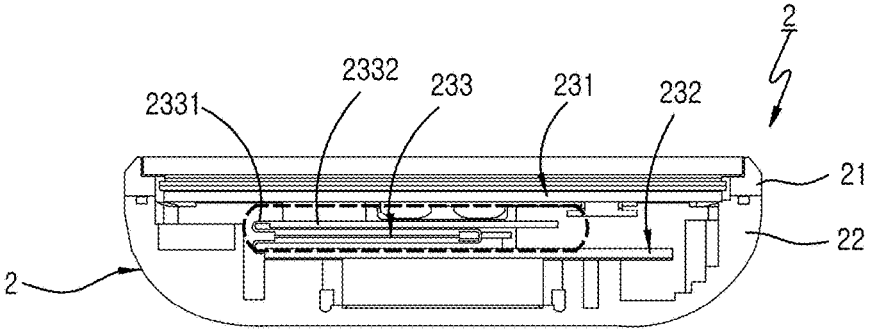
FIG. 15 is a cross-mid sectional view illustrating an example state, in which the substrate is applied to the wearable electronic device according to embodiments of the present disclosure.

FIG. 14 is a configuration view of the substrate applied to the wearable electronic device 1. FIG. 15 is a cross-mid-sectional view illustrating a state, in which the substrate is applied to the wearable electronic device 1.

Referring to FIGS. 14 and 15, the substrate unit 23 may include the first substrate 231, the second substrate 232, and the connector 233 having the certain length for electrically coupling the first substrate 231 and the second substrate 232 to each other. In one embodiment, the connector 233 may be disposed with a plate 2332 having a certain thickness with certain intervals on a top end of the FPC 12 having a signal pattern. In one embodiment, the plate 2332 may be a rigid dielectric substrate. In one embodiment, the plate 2332 may include a ground layer. In one embodiment, the plate 2332 may be fixed to the FPC 12 by bonding. In one embodiment, all the first substrate 231, the second substrate 232, and the plate 2332 disposed on the connector 233 may be attached and fixed to one FPC 12.

According to the various embodiments, the connector 233 may be alternately disposed with a plurality of flexible sections A1 to be bendable a plurality of times and at least one rigid section A2. In one embodiment, the flexible section A1 may be applied exposing the FPC 12 and the rigid section A2 may be applied by attaching the plate 2332 having the certain interval to the FPC 12.

In one embodiment, among the connector 233, the plate 2332 may be overlapped to be mutually folded due to flexibility of a bent part 2331 not disposed with the plate 2332 and exposed with the FPC 12. According to the various embodiments, an elastic treatment is performed on the bent part 2331 to allow the bent part 2331 to be folded in a certain direction, thereby easily folding the bent part 2331 while assembling.

According to the various embodiments, when the first substrate 231 and the second substrate 232 are assembled by the connector 233 having a configuration of a plurality of alternately disposed bent parts 2331 and the plate 2332, components may be mounted by separating the upper case frame 21 from the lower case frame 22 with the length of the connector 233, thereby improving assembling properties.

According to the various embodiments, the first substrate 231 and the second substrate 232 are electrically coupled using the FPC 12, thereby containing relatively more many signal patterns. As a result, components may be freely disposed between the first substrate 231 and the second substrate 232, thereby excluding limitations in design and maximizing space availability.

Figure 16:
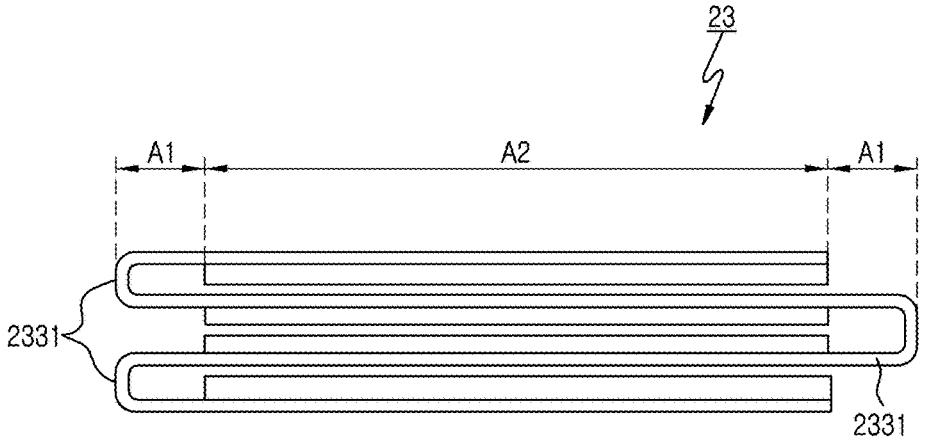
FIG. 16 is a configuration view illustrating an example state, in which the substrate applied to the wearable electronic device is folded according to embodiments of the present disclosure.

FIG. 16 is a configuration view illustrating a state, in which the substrate applied to the wearable electronic device 1 is folded.

Referring to FIG. 16, when the upper case frame 21 and the lower case frame 22 are assembled after the first substrate 231 is fixed to the upper case frame 21 and the second substrate 232 is fixed to the lower case frame 22, the connector 233 is deposited to allow the plate 2332 to be folded and overlapped. In this case, the ground layer is formed on the plate 2332, thereby excluding a signal interference occurring in the signal pattern disposed on the FPC 12 in positions corresponding to the respective plates 2332 and shielding a noise thereof. The ground layer may be formed on the dielectric substrate.

Figure 17:
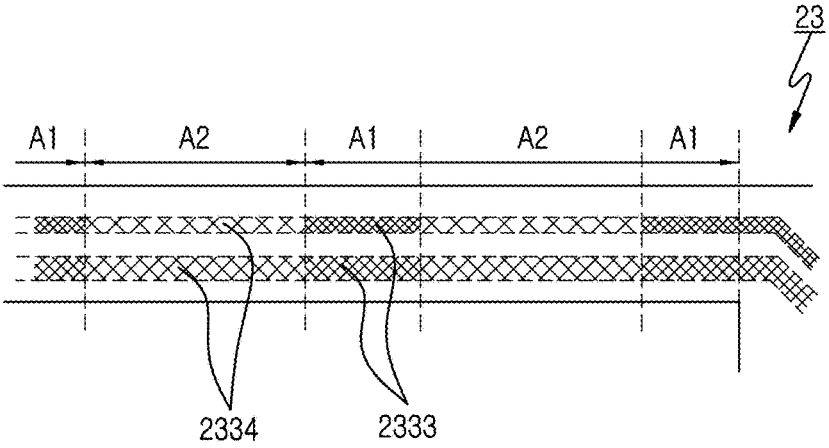
FIG. 17 is a mid-sectional configuration view of an example signal line of the substrate applied to the main body of the wearable electronic device according to embodiments of the present disclosure.

FIG. 17 is a midsectional configuration view of an example signal line of the substrate applied to the main body of the wearable electronic device according to embodiments of the present disclosure.

Referring to FIG. 17, a wiring pattern 2333 of the flexible section A1 and a wiring pattern 2334 of the rigid section A2 may have the same line width and may be formed hatch patterns having density different from one another. In one embodiment, the wiring pattern 2333 of the flexible section A1 is more densely formed than the wiring pattern 2334 of the rigid section A2, thereby maximizing flexibility simultaneously with providing impedances 50Ω, 90Ω, and 100Ω having the same performance while uniformly maintaining wiring widths of the flexible section A1 and the rigid section A2.

According to the various embodiments, the wiring patterns 2333 and 2334 of the flexible section A1 and the rigid section A2 maintain the same line width and have density different from each other, thereby controlling an impedance value to be 50Ω, 90Ω, or 100Ω without an increase in a width of the connector 233. Accordingly, the substrate 23 may improve a signal flow and electric properties without an increase in a size of the connector 233.

Figure 18:
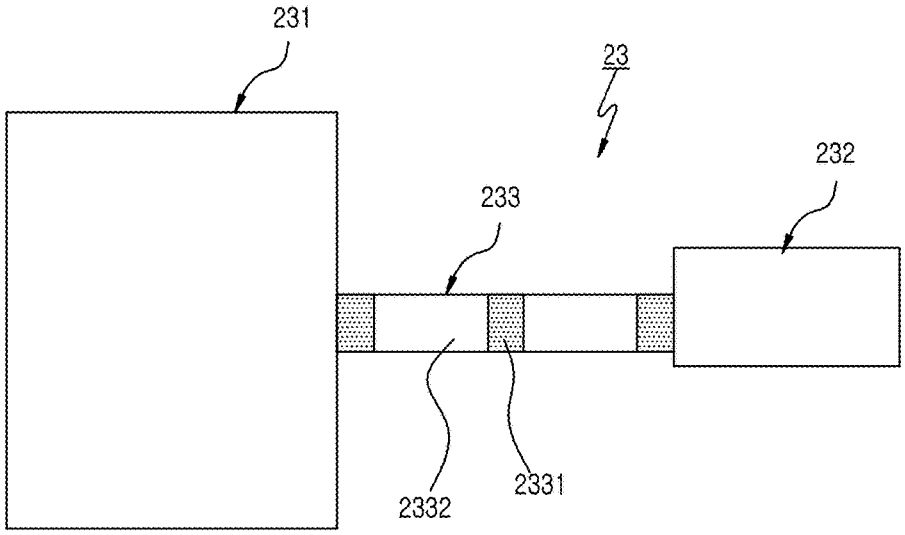
FIG. 18 is a configuration diagram of an example substrate unit, illustrating an example state, in which two substrates are electrically coupled to each other by a connector according to embodiments of the present disclosure.

FIG. 18 is a configuration diagram of the board device, illustrating a state, in which two substrates are electrically connected to each other by the connector 233.

Referring to FIG. 18, the various embodiments may be applied to the substrate unit 23, in which the first substrate 231 is relatively greater than the second substrate. In one embodiment, the first substrate 231 may be a main substrate and the second substrate 232 may be a sub substrate or a one-side printed circuit board (PCB). The first substrate 231 and the second substrate 232 may be electrically coupled to each other by the connector 233.

According to the various embodiments, the two substrates 231 and 232 are provided to allow the bent part 2331 to be alternately disposed by a plurality of plates 2332 but are not limited thereto. For example, two or more substrates may be electrically coupled to one another by two or more connectors.

According to the various embodiments, two substrates are coupled by one connector but are not limited thereto. For example, two or more connectors may be separately disposed from one another with certain intervals on two substrates.

Figure 19:
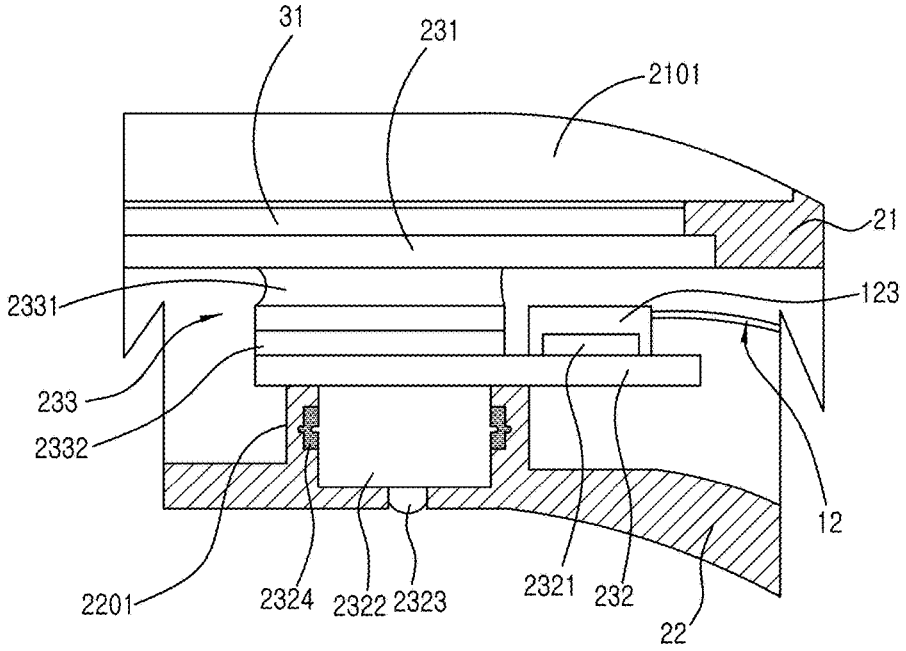
FIG. 19 is a cross-mid sectional view illustrating an example state, in which the two substrates are applied to the main body of the wearable electronic device according to embodiments of the present disclosure.
Figure 20:
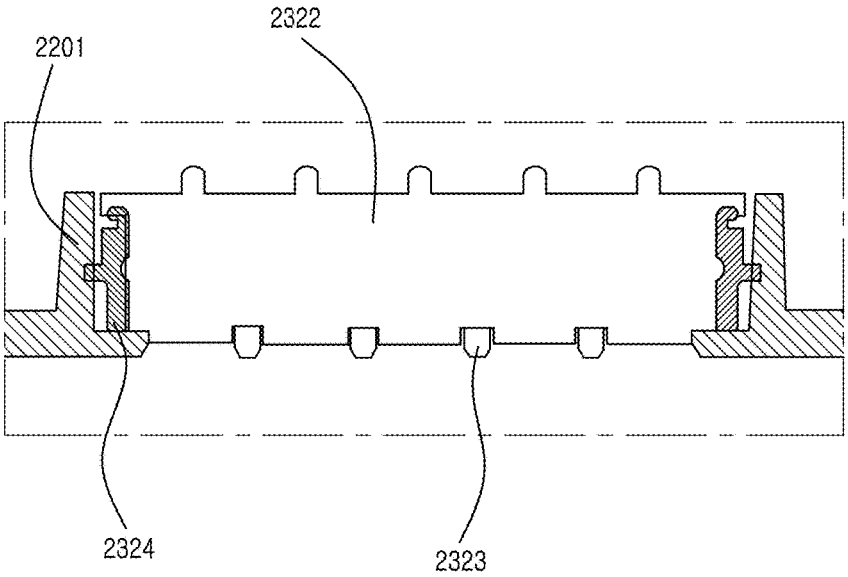
FIG. 20 is a cross-mid sectional view illustrating an example state, in which a pogo connector is installed in the main body of the wearable electronic device according to embodiments of the present disclosure.

FIG. 19 is a cross-midsectional view illustrating a state, in which two substrates are applied to the main body 2 of the wearable electronic device 1. FIG. 20 is a cross-midsectional view illustrating a state, in which a pogo connector is installed in the main body 2 of the wearable electronic device 1.

Referring to FIGS. 19 and 20, the first substrate 231 may be fixed to the upper case frame 21 and the second substrate 232 may be fixed to the lower case frame 22. In one embodiment, the first substrate 231 and the second substrate 232 are perpendicularly separate from each other and may be installed in locations mutually overlapped. In one embodiment, the first substrate 231 and the second substrate 232 may be electrically coupled to each other by the connector 233. In one embodiment, the connector 233 may be deposited to allow the plates 2332 to be in mutually surface contact with one another due to flexibility of the bent part 2331.

According to the various embodiments, a display module 31 for the display unit 3 may be installed on a top of the first substrate 231. In one embodiment, the display module 31 may further include a touch sensor for inputting data. In one embodiment, a display window 2101 may be further installed on a top of the display module 31 of the upper case frame 21.

According to the various embodiments, a terminal connector 2321 may be mounted on a part of a top of the second substrate 232. In one embodiment, the first connector 123 of the FPC 12, withdrawn from the strap 10 toward the inside of the main body 2, may be electrically coupled to the terminal connector 2321. In one embodiment, a pogo connector 2322 including a plurality of pogo pins 2323 may be mounted on a bottom of the second substrate 232. The pogo connector 2322 is installed on a bottom of the lower case frame 22 to be exposed and may be used for data communication or charging a battery pack when mounting the wearable electronic device 1 on an additional detachable device. In one embodiment, the detachable device may be an exclusive dock for charging the wearable electronic device 1 or transmitting and receiving data.

According to the various embodiments, since being disposed on the lower case frame 22 to expose the pogo pins 2323, the pogo connector 2322 may have a waterproof structure. In one embodiment, a connector sealing member 2324 may be further installed along an outer circumferential surface of the pogo connector 2322. In one embodiment, a bushing 2201 for mounting the pogo connector 2322 may be elongated with a certain length on an inner surface of the lower case frame 22. In one embodiment, when the pogo connector 2322 is mounted on a mounting space of the bushing 2201, the connector sealing member 2324 disposed on the outer circumferential surface of the pogo connector 2322 may be tightly attached to an inner circumferential surface of the bushing 2201, thereby preventing permeation of impurities or water from the space of the lower case frame 22, to which the pogo pins 2323 are exposed. In one embodiment, the connector sealing member 2324 may be formed of silicone or rubber.

Figure 21A:
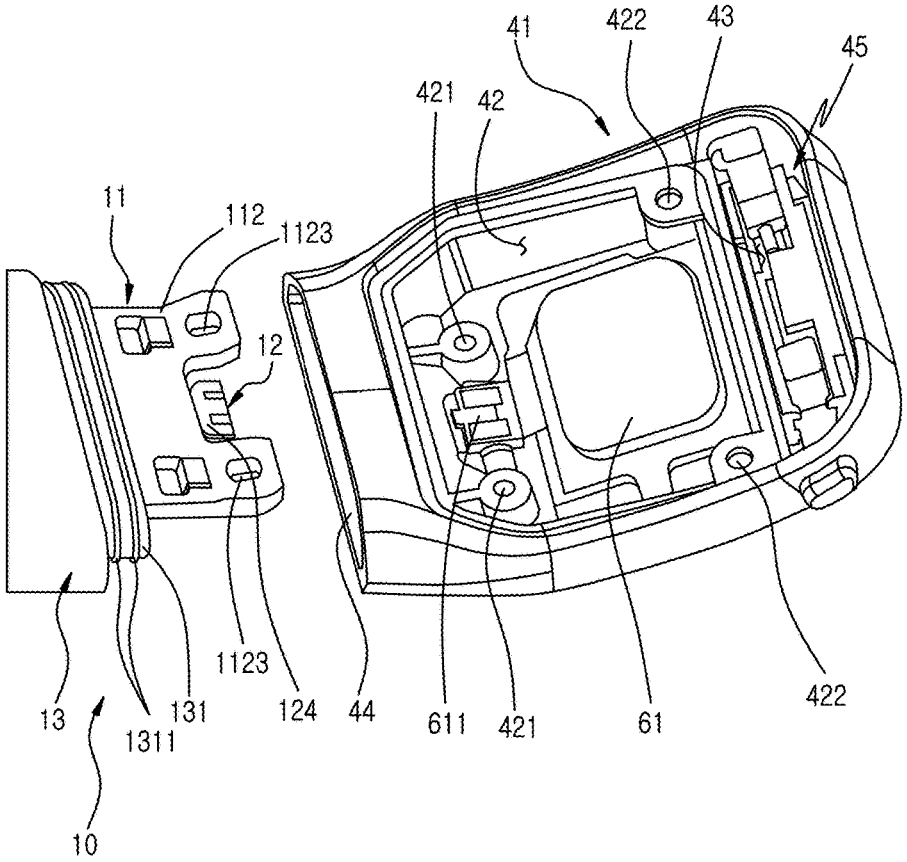
FIG. 21A and FIG. 21B are diagrams illustrating an example combination between a housing of a buckle and the strap according to embodiments of the present disclosure.
Figure 21B:
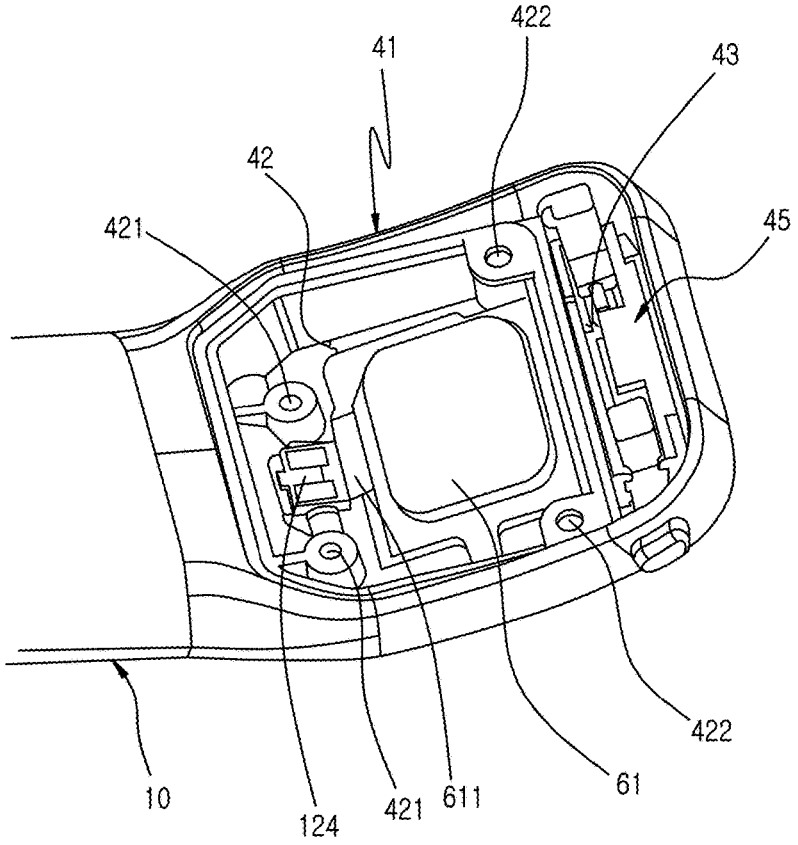

FIGS. 21A and 21B are diagrams illustrating a combination between a housing of the buckle 4 and the strap 10.

Referring to FIG. 21A, the housing 41 may include a unit containing space 42 with an open top and a locking unit containing space 43. In one embodiment, the unit containing space 42 and the locking unit containing space 43 may be separate from each other due to a barrier. In one embodiment, an electronic component applied to the unit containing space 42 may be a speaker module 61 including a connection terminal 611. However, it is not limited thereto, and for example, the electronic component may be a vibrating unit or a microphone. In one embodiment, the unit containing space 42 may be formed with a plurality of fastening openings 421 and 422. The plurality of fastening openings 421 and 422 may be fastening openings fastened by screws while the two spaces are in a vacuum state due to a cover 46 that will be described later. In one embodiment, a locking unit 45 may be installed in the locking unit containing space 43. In one embodiment, the locking unit 45 may lock an operation of a buckle link 47.

According to the various embodiments, a strap containing opening 44 coupled to the unit containing space 42 may be formed on one side of the housing 41. An end of the strap 10 may be inserted and fixed to the strap containing opening 44.

According to the various embodiments, the strap 10 may be formed to allow the core extension 112 to protrude from the end. In one embodiment, the band member 13 of the strap 10 may be injected to expose an end of the core extension 112, on which a penetration opening 1123 and the third connector 124 of the FPC 12 are disposed. In one embodiment, an end of the band member 13 may be formed with a containing opening mounting protrusion 131 insertable into the strap containing opening 44 of the housing 41 by forcibly inserting. In one embodiment, the containing opening mounting protrusion 131 may be further formed with at least one ring-shaped sealing protrusion 1311 more protruding along an outer circumferential surface. However, it is not limited thereto, an additional ring-shaped member for sealing may be further installed.

Referring to FIG. 21B, the containing opening mounting protrusion 131 of the strap may be forcibly inserted into the strap containing opening 44 of the housing 41. In one embodiment, the at least one ring-shaped sealing protrusion 1311 formed on the containing opening mounting protrusion 131 is closely attached to an inner circumferential surface of the strap containing opening 44 of the housing 41, thereby sealing against soil.

In one embodiment, the containing opening mounting protrusion 131 of the strap 10 is completely mounted on the strap containing opening 44 of the housing 41, the penetration opening 1123 of the core extension 112 may be inserted into the unit containing space 42 of the housing 41 and may be disposed in a location corresponding to the fastening opening 421. In one embodiment, simultaneously, the third connector 124 of the FPC 12 disposed on the core extension 112 may become in contact with the connection terminal 611 of the speaker module 61 mounted on the unit containing space 42 of the housing 41. In one embodiment, the third connector 124 and the connection terminal 611 may be fixed to each other by soldering or may be electrically coupled to each other by combining with a connector.

Figure 22A:
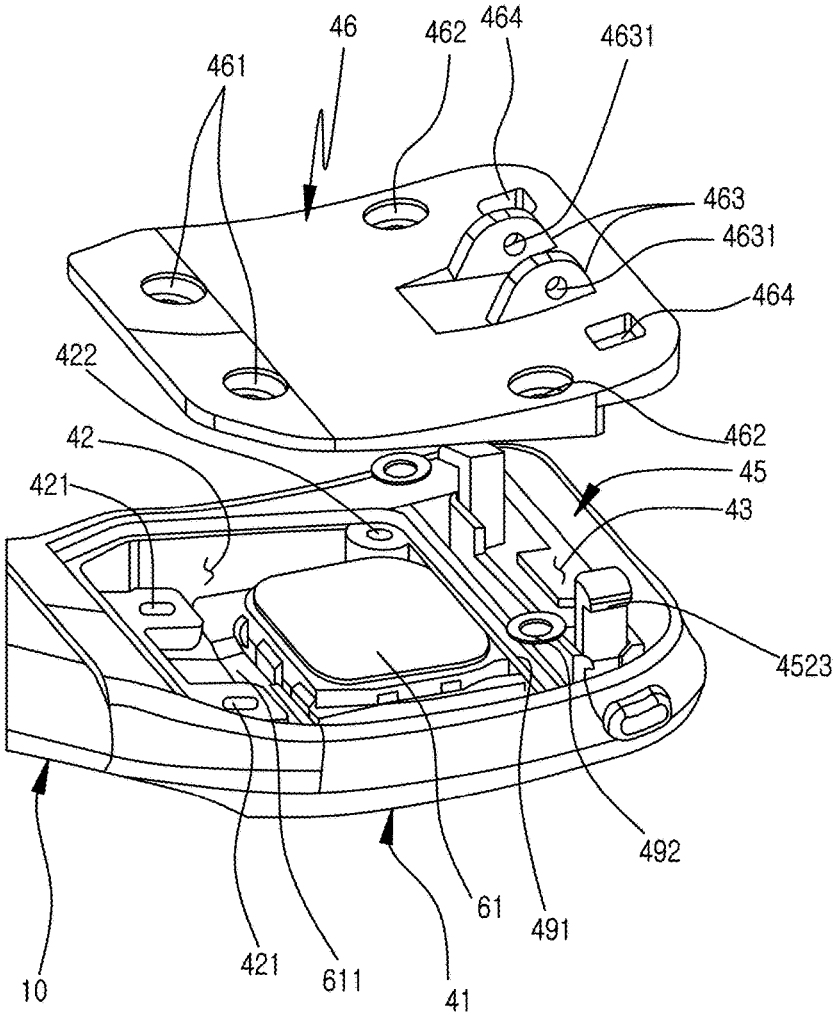
FIG. 22A and FIG. 22B are diagrams illustrating an example combination between the housing and a cover of the buckle according to embodiments of the present disclosure.
Figure 22B:
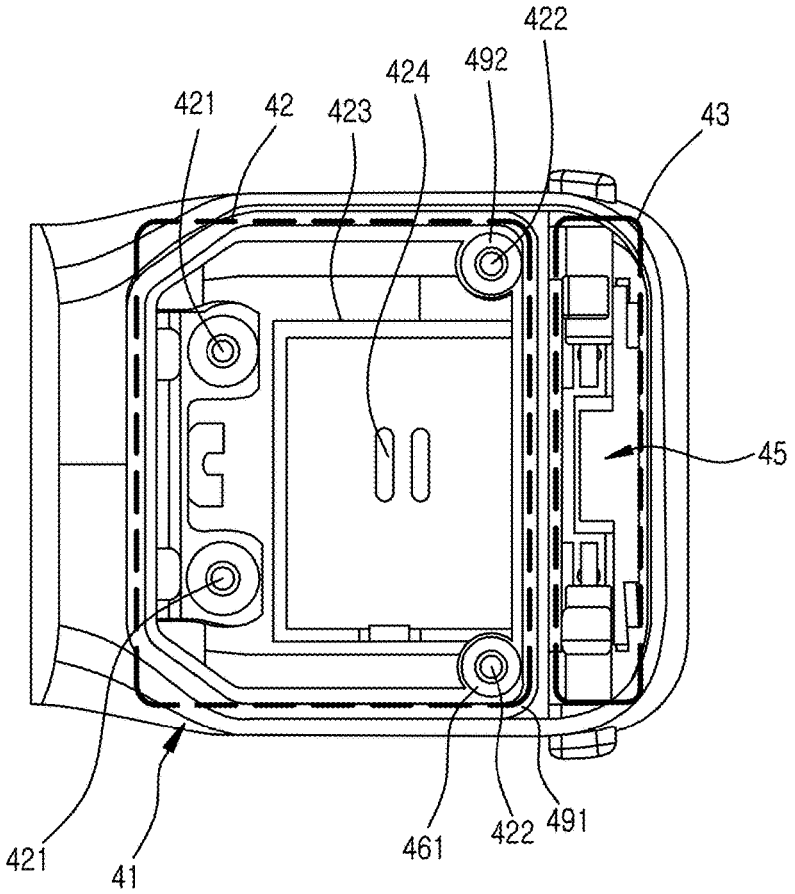

FIGS. 22A and 22B are diagrams illustrating a combination between the housing 41 of the buckle 4 and the strap 10.

Referring to FIG. 22A, as shown in FIG. 21B, the cover 46 may be installed to cover the unit containing space 42 and the locking unit containing space 43 of the housing 41 at the same time while the strap 10 is completely combined with the housing 41.

According to the various embodiments, a plurality of screw fastening openings 461 and 462 may be disposed in proper positions on the cover 46. In one embodiment, the screw fastening openings 461 and 462 may be disposed in locations corresponding to the fastening openings 421 and 422 formed on the unit containing space 42 of the housing when the cover 46 is mounted on the housing 41.

According to the various embodiments, a pair of hinge arms 463 formed with a hinge opening 4631, respectively, may be formed on an outer surface of the cover 46. In one embodiment, the pair of the hinge arm 463 may fix the buckle link 47 installed on the outer surface of the cover 46 to be pivotable. In one embodiment, the cover 46 may be formed with a first penetration hole 464 to allow a first protruding end 4523 of a locker 452 of the locking unit 45 to penetrate and protrude from the outer surface of the cover 46.

According to the various embodiments, since being installed with the speaker module 61 that is an electronic component, the unit containing space 42 of the housing may be formed to be a sealed space for waterproofing or soil resisting. In one embodiment, a cover sealing member 491 may be further installed along an edge of the unit containing space 42. In one embodiment, a screw sealing member 492 is further disposed in a location corresponding to the fastening opening 422 formed in the unit containing space 42, thereby preventing pollution caused by dusts, water, etc. inserted into the unit containing space 42 through the screw fastening opening 462.

Referring to FIG. 22B, there is a top view of the housing 41 without the speaker module 61. A barrier 423 for containing the speaker module 61 may be formed in the unit containing space 42, and a speaker hole 424 may be formed in a center thereof. In one embodiment, when the speaker module 61 is fixed with the barrier 423 as a boundary, flooding or pollution caused by water or filth inserted through the speaker hole 424 may be prevented by the speaker module 61. In one embodiment, the speaker module 61 may be designed to be waterproof or may include waterproof non-woven fabric attached to a sound amplifying side.

Figure 23:
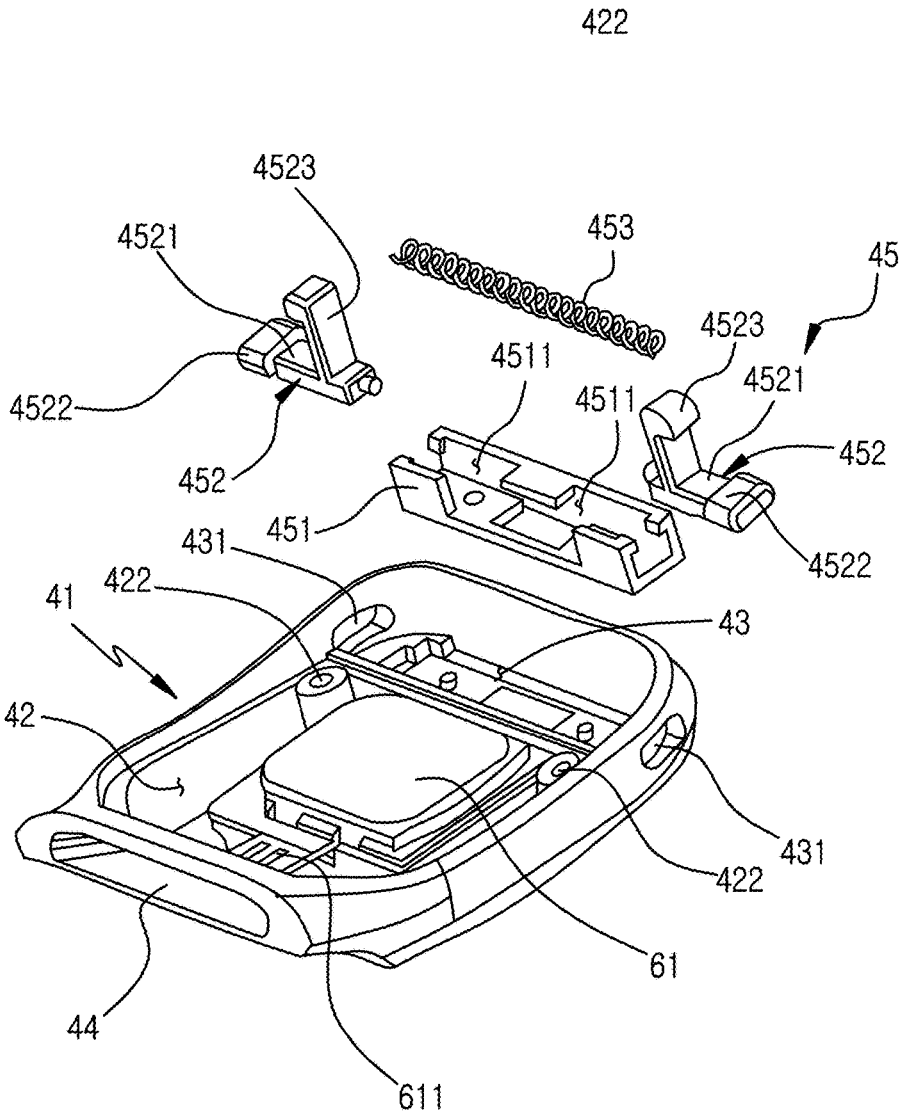
FIG. 23 is a separate perspective view of an example locking unit disposed in the buckle according to embodiments of the present disclosure.

FIG. 23 is a separate perspective view of the example locking unit 45 of the buckle 4.

Referring to FIG. 23, the locking unit 45 may be mounted on the locking unit containing space 43 of the housing 41. According to the various embodiments, the locking unit 45 may include a locker housing 451 having a pair of locker containing spaces 4511 and a pair of lockers 452 contained in the locker containing spaces 4511, respectively. The locker 452 may include a locker body 4521 contained in the locker containing space 4511, the first protruding end 4523 protruding upwards from the locker body 4521, and a second protruding end 4522 protruding from the locker body 4521 to a horizontal outside of the locker housing 451. In one embodiment, the first protruding end 4523 of the locker 452 protrudes through the first penetration hole 464 of the cover 46 and locks the buckle link 47, the second protruding end 4522 of the locker 452 protrudes outwards from the second penetration hole 431 formed on both sides of the housing 41 and releases the locked buckle link 47 by pressurizing the second protruding end 4522. In one embodiment, a compressive coil spring 453 may be disposed between the pair of lockers 452. In one embodiment, the compressive coil spring 453 may provide a pressurizing force to pressurize the pair of lockers 452 outwards, respectively. In one embodiment, the first protruding end 4523 may be formed with a top end having a hook shape to allow a hanging piece 4733 formed on a hanging member 473 of the buckle link 47 that will be described later to easily hang thereon.

According to the various embodiments, the locking unit 45 may be configured by inserting the pair of lockers 452 into the locker housing 451 and disposing the compressive coil spring 453 between the lockers 452. In one embodiment, the coupled locking unit 45 may be mounted in the locking unit containing space 43 of the housing 41. In one embodiment, when the locking unit 45 is mounted on the locking unit containing space 43 of the housing 41, the second protruding end 4522 of the locking unit 45 may be installed to partially protruded through the second penetration hole 431 formed on the side of the housing 41.

According to the various embodiments, the speaker module 61 is mounted in the unit containing space 42 of the housing 41, the locking unit 45 is mounted in the locking unit containing space 43 of the housing 41, and then the cover sealing member 46 and the screw sealing member 492 are interposed, thereby mounting the cover 46. In one embodiment, when the cover 46 is mounted, the screw fastening openings 461 and 462 of the cover 46 and the fastening openings 421 and 422 of the unit containing space 42 may be disposed in corresponding locations. In one embodiment, the cover 46 may be screw-fastened to the unit containing space 42 of the housing 41 through the screw fastening openings 461 and 462, thereby completely assembling the housing 41.

Figure 24A:
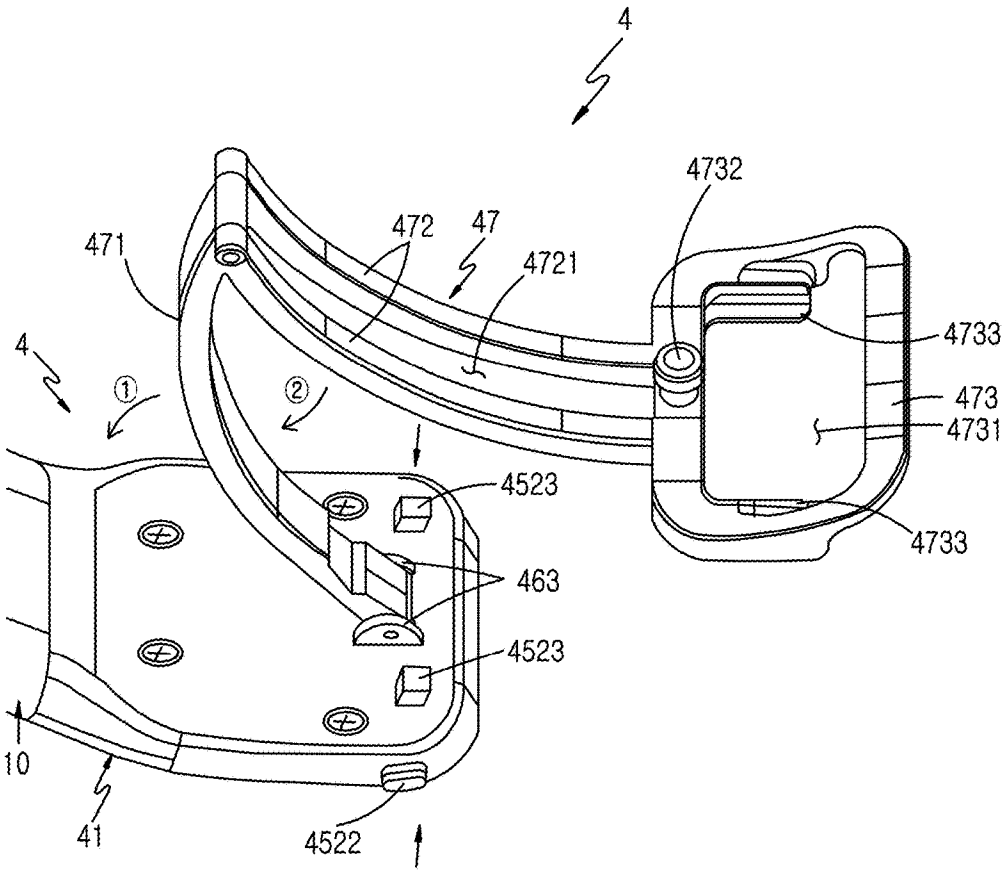
FIG. 24A and FIG. 24B are diagrams illustrating an example operation of a buckle link of the buckle according to embodiments of the present disclosure.
Figure 24B:
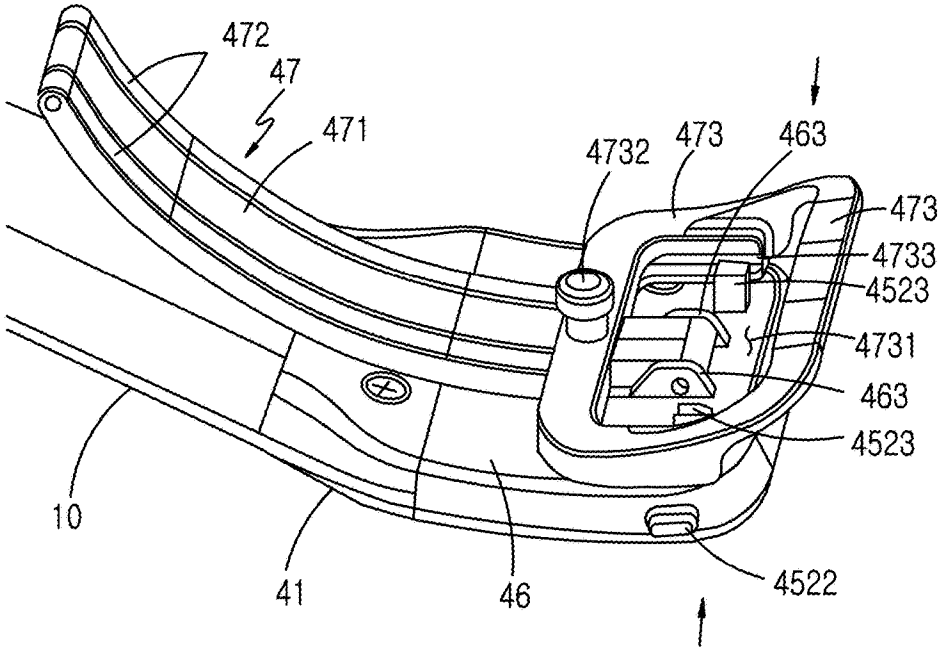

FIGS. 24A and 24B are diagrams illustrating an operation of the buckle link 47 of the buckle 4.

Referring to FIG. 24A, the buckle link 47 may include a first link 471 fixed to the pair of hinge arms 463 formed on the outer surface of the cover 46 installed in the housing 41 to be pivotable, a second link 472 hinge-coupled to an end of the first link 471 to be pivotable, the hanging member 473 formed on an end of the second link 472 and locked to be folded by the first protruding end 4523 of the locking unit 45 penetrating the first penetration hole 464 of the cover 46 and protruding therefrom when the first link 471 and the second link 472 are folded.

According to the various embodiments, the second link 472 may be formed with a first link containing space 4721. In one embodiment, when the first link 471 pivots in a direction ① and is in contact with the housing 41 and the second link 472 pivots in a direction ② and flows toward the second link 472, the first link 471 and the second link 472 are mutually folded to allow the first link 471 to be contained in the first link containing space 4721 of the second link 472. In one embodiment, a maximum folded state of the buckle link 47 is identical as shown in FIG. 24B.

According to the various embodiments, the hanging member 473 may be formed on the end of the second link 472 as an oblong. In one embodiment, the hanging member 473 may include an opening 4731 and the hanging pieces 4733 may protrude from both ends of the opening 4731. In one embodiment, when the second link 472 and the first link 471 are mutually folded, the hanging pieces 4733 hangs on the first protruding end 4523 of the locking unit 45, thereby maintaining the folded state as shown in FIG. 24B.

According to the various embodiments, the hanging member 473 may be formed with a band fixing pole 4732 protruding upwards. The band fixing pole 4732 may be inserted into any one of a plurality of openings of the other strap 10' of the wearable electronic device 1, thereby mutually coupling the one strap 10 and the other strap 10'. In one embodiment, the other strap 10' may be fixed by the band fixing pole 4732 while penetrating the opening 4731 of the hanging member 473. In one embodiment, the first link 471 and the second link 472 of the buckle link 47 may form a curve while being mutually folded. In one embodiment, the buckle link 47 forming the curve may support the strap 10 while the strap 10 is worn on the wrist of the user.

According to the various embodiments, as shown in FIG. 24B, while the first link 471 and the second link 472 of the buckle link 47 are mutually folded and the hanging pieces 4733 of the hanging member 473 hang on the first protruding ends 4523 of the locking unit 45, when the second protruding ends 4522 of the locking unit 45 protruding from both sides of the housing 41 are pressurized in a direction of an arrow shown in FIG. 24B, the hanging pieces 4733 of the hanging member 473 may be released by a retracting operation of the first protruding ends 4523. In one embodiment, in this case, as shown in FIG. 24A, the first link 471 and the second link 472 may pivot and may be separate from each other.

Figure 25A:
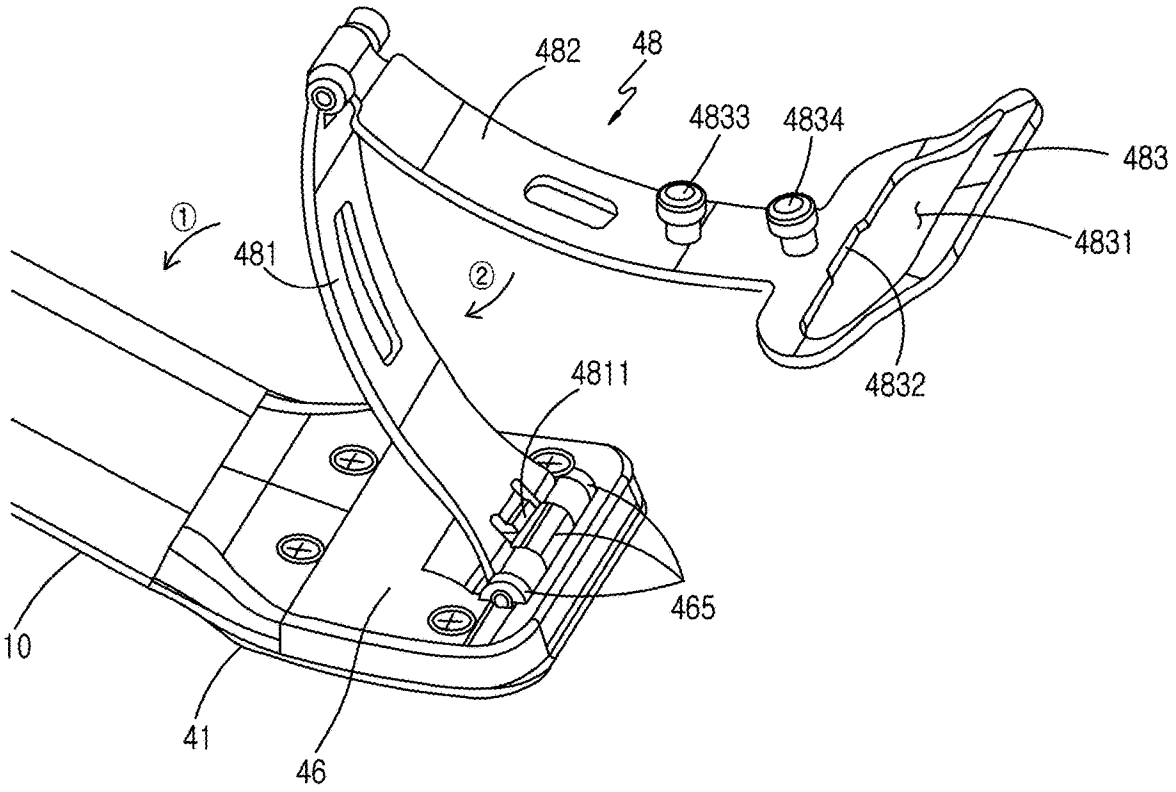
FIG. 25A and FIG. 25B are diagrams illustrating an example operation of a buckle link of the buckle according to embodiments of the present disclosure.
Figure 25B:
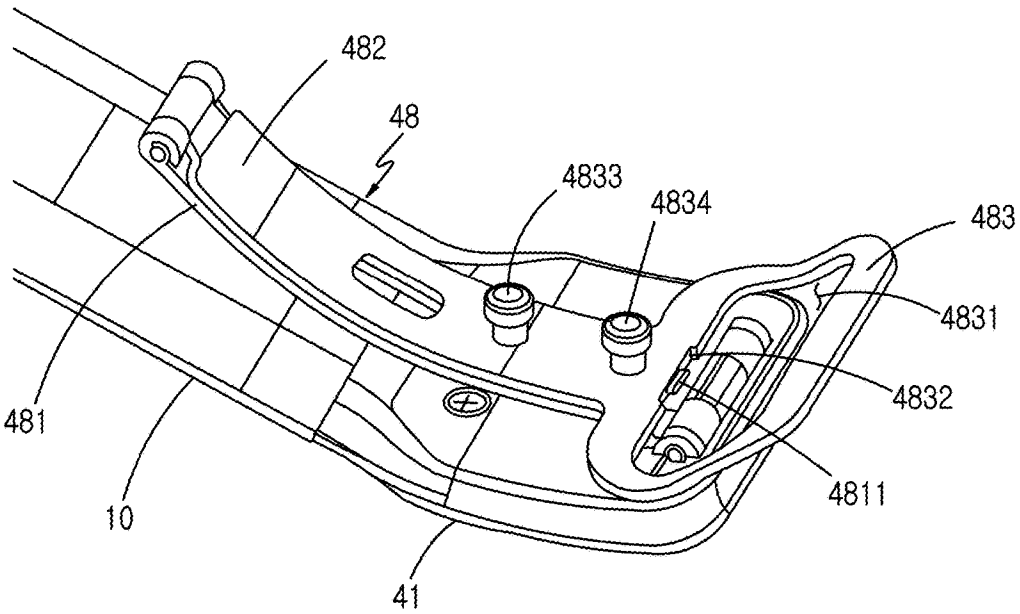

FIGS. 25A and 25B are diagrams illustrating an operation of the buckle link 47 of the buckle 4.

Referring to FIG. 25A, the buckle link 47 may include a first link 481, fixed to the pair of hinge arms 465, formed on the outer surface of the cover 46, installed in the housing 41 to be pivotable, and a second link 482, hinge-coupled to an end of the first link 481 to be pivotable, a hanging member 483 including a hanging part 4832, formed on an end of the second link 482, and hanging on a protruding piece 4811 protruding from a hinge-coupled part of the first link 481 when the first link 481 and the second link 482 are folded.

According to the various embodiments, the first link 481 and the second link 482 may be folded to be mutually folded. In one embodiment, when the first link 481 pivots in the direction ① and is in contact with the housing 41 and the second link 482 pivots in the direction ② and is in contact with the first link 481, the first link 481 and the second link 482 may be mutually folded. In one embodiment, the first link 481 and the second link 482 are in mutual contact with each other as shown in FIG. 25B, which may be a folded state.

According to the various embodiments, the hanging member 483 may be formed on the end of the second link 482 as an oblong. In one embodiment, the hanging member 483 may include an opening 4831 and the hanging part 4832 having a step may be formed on one side of the opening 4831. In one embodiment, when the second link 482 and the first link 481 are mutually folded, the hanging part 4832 hangs on the protruding piece 4811 of the first link 481, thereby maintaining the folded state as shown in FIG. 25B.

According to the various embodiments, the hanging member 483 may be formed with a pair of band fixing poles 4833 and 4844 protruding upwards. The band fixing poles 4833 and 4844 may be inserted into two of a plurality of openings of the other strap 10' of the wearable electronic device 1 at the same time, thereby strongly coupling the one strap 10 and the other strap 10' without movement. In one embodiment, the first link 481 and the second link 482 of the buckle link 48 may form a curve while being mutually folded, thereby supporting the strap 10 worn on the wrist of the user.

According to the various embodiments, there has illustrated and described a strap or a fastening structure between straps, including a buckle link and fixed by at least one band fixing pole. However, it is not limited thereto and various shapes of straps may be provided.

In one embodiment, in addition to the buckle type, various shapes may be applied independently or in parallel, such as an elastic band type without segmentation, a snap fastener type, and a bracelet type having segmentation but being apart when being worn and maintaining a shape after being worn.

Figure 26:
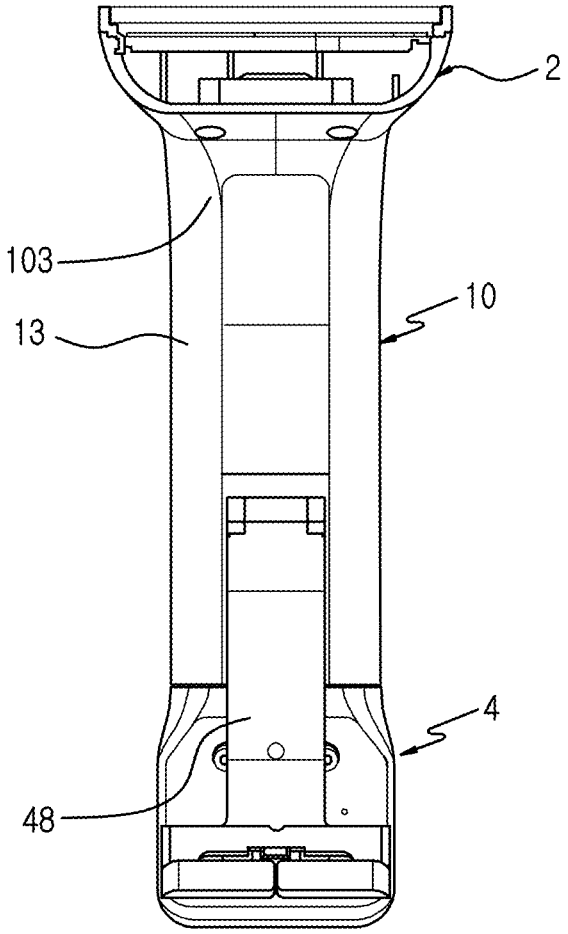
FIG. 26 is a diagram of an example strap without a cover for locking electronic components according to embodiments of the present disclosure.

FIG. 26 is a diagram of the strap 10 without a cover for locking electronic components.

Referring to FIG. 26, one end of the strap 10 may be coupled to the main body 2 and another end thereof may be coupled to the buckle 4. In one embodiment, since the strap 10 may be coupled to the main body 2 and the buckle 4 by using coupling methods described above, a detailed description thereof will be omitted.

In the above embodiments, the band member 13 is injected to expose at least one part of the core member 11 and the exposed part is finished using the additional cover 14. However, it is not limited thereto. The strap 10 may be completed while containing an electronic component such as the camera 5 without the additional cover 14.

As shown in FIG. 26, in one embodiment, the additional cover 14 may be excluded from the rear 103 of the band member 13 of the strap 10. In this case, before injecting the band member 13 to a core member, the electronic component is electrically coupled to an electric connection unit applied to the core member and then the band member 13 is injected to perfectly surround the electronic component, thereby completing the strap 10. In one embodiment, in this case, the core member may include an additional fixing unit for fixing the electronic component. In one embodiment, the fixing unit may be an additional mechanical structure provided in the core member.

According to the various embodiments, the strap 10 may be completed by primarily injecting one side of the core member as a first band member, mounting the electronic component through another side of the core member, and secondarily injecting and finishing the other side of the core member using a second band member.

According to the various embodiments, the strap 10 may be complete by doubly injecting the band member into the core member, exposing a part to be mounted with the electronic component, mounting the electronic component on the exposed part, and then thirdly injecting.

According to the various embodiments, since excluding an additional detachable cover, the strap without cover may allow the wearable electronic device 1 to have a beautiful entire external shape.

FIGS. 27A to 27E are views illustrating example states in which electronic components are applied to straps of wearable electronic devices according to the various embodiments.

In the above embodiments, a watch type electronic device has been described as the wearable electronic device 1 and at least one strap fixed to a main body of the electronic device has been described. However, it is not limited thereto and the embodiments may be applied to various straps provided in various wearable devices.

Figure 27A:
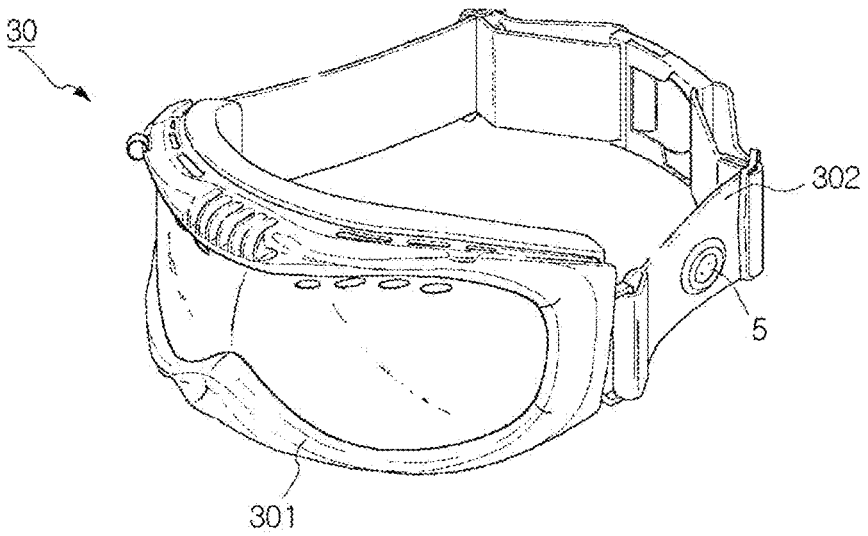
FIG. 27A, FIG. 27B, FIG. 27C, FIG. 27D and FIG. 27E are configuration views illustrating example states, in which electronic components are applied to straps of the wearable electronic device according to embodiments of the present disclosure.

Referring to FIG. 27A, a goggle type device 30 is illustrated as the wearable device. In one embodiment, the goggle type device 30 may include a device body 301 and a head band 302 as a strap fixed to the device body 301 to allow the device body 301 to be worn on the head of the user. In one embodiment, the head band 302 may be installed with at least one electronic component. In one embodiment, the electronic component may be one of the camera 5 and the speaker.

Figure 27B:
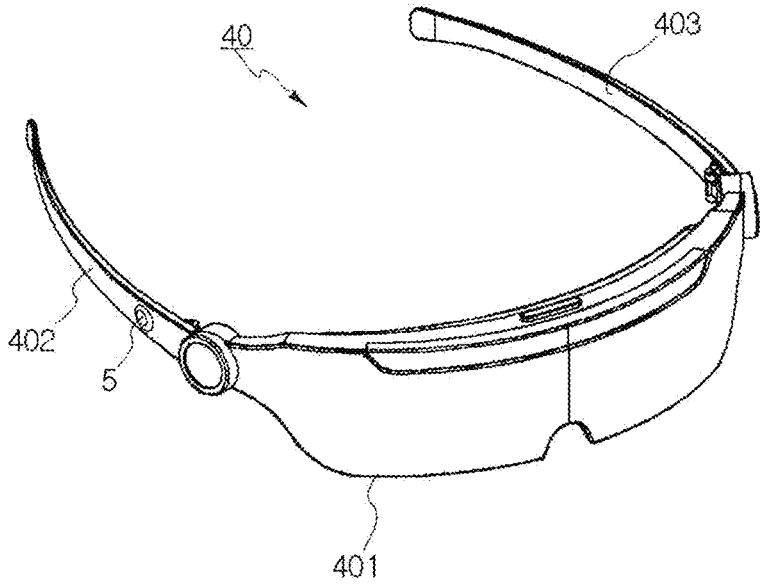

Referring to FIG. 27B, an eyeglass type device 40 is illustrated as the wearable device. The eyeglasses type device 40 may be installed with an eyeglass rim 401 for containing a pair of lenses and a pair of temples 402 and 403 fixed to both ends of the eyeglass rim 401 to be worn on auricles of the user. The pair of temples 402 and 403 may be used as the strap according to the embodiments. In one embodiment, one of the pair of temples, 402, may be installed with the camera 5 as the electronic component. In one embodiment, both the pair of temples 402 and 403 may be installed with cameras 5, respectively.

Figure 27C:
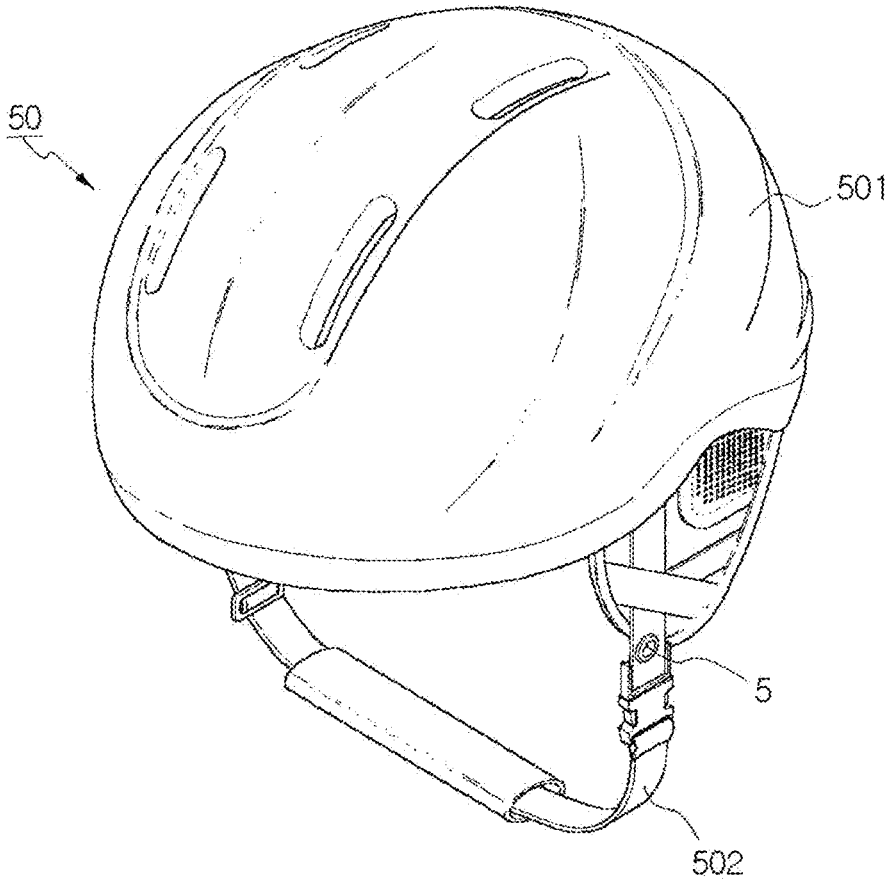

Referring to FIG. 27C, a helmet type device 50 is illustrated as the wearable device. In one embodiment, the helmet type device 50 may include a helmet body 501 worn on the head of the user and a strap 502 withdrawn from the helmet body 501 and hanging on the chin of the user. In one embodiment, the camera 5 may be installed on the strap 502.

Figure 27D:
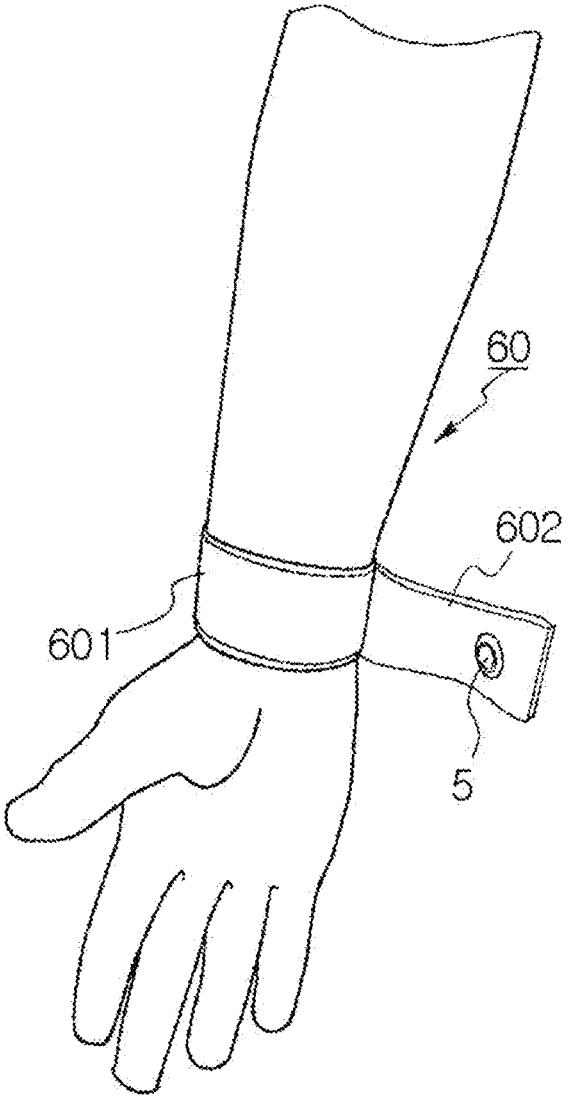

Referring to FIG. 27D, an extension 602 extended from a cuff 601 of a top 60 of the user may be used as the strap. In one embodiment, the camera 5 may be installed on the extension 602.

Figure 27E:
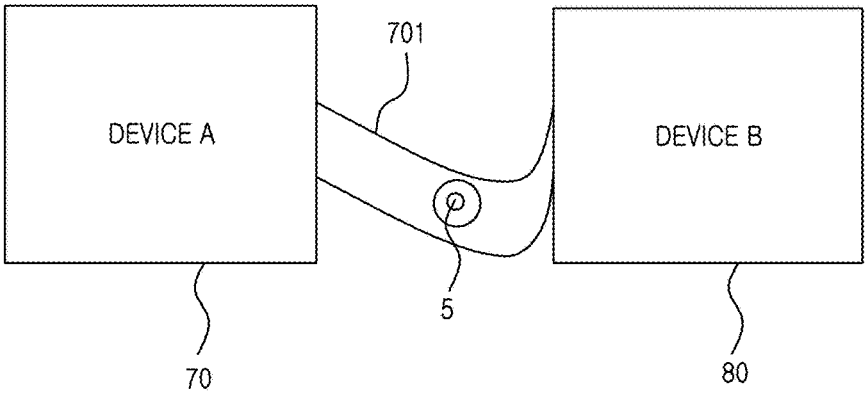

Referring to FIG. 27E, two electronic devices 70 and 80 may be coupled or electrically coupled by a certain strap 701. In one embodiment, the two electronic devices 70 and 80 may be electronic devices. In one embodiment, when being electronic devices, the two electronic devices 70 and 80 may be speakers. In one embodiment, the camera 5 may be installed as electronic components on the strap 701 used as a connector for the two electronic devices 70 and 80.

The various embodiments provide an electronic watch including a main body including a display, at least one strap connected to at least one part of the main body, and a camera module mounted on a part of the at least one strap.

According to the various embodiments, the camera module may be separate from the main body with a selected distance.

According to the various embodiments, the main body may further include an extension extended from the main body and the camera module may be mounted on the extension.

According to the various embodiments, the camera module includes a lens exposed through a first side of the at least one strap and a sealing member exposed toward a second side of the at least one strap and adjacent to the camera module.

According to the various embodiments, the lens and at least an exposed part of the sealing member may be disposed to face opposite directions against each other.

In one embodiment, the camera module includes a lens and a first direction the display faces and a second direction the lens faces may form an angle within a range of from about 60° to about 120°.

According to the various embodiments, the at least one strap may include a first member such as the core member 11 surrounding at least one part of the camera module and a second member such as the band member 13 enclosing at least one part of the first member.

According to the various embodiments, the first member may include first softness and the second member may include second softness greater than the first softness.

According to the various embodiments, an electric connecting member electrically coupling the main body to the camera module may be further included.

According to the various embodiments, the second member may be formed to enclose at least one part of the electric connecting member.

According to the various embodiments, the electric connecting member may include at least one of an FPC or a thin cable.

According to the various embodiments, at least one part of the electric connecting member may be located between the first member and the second member.

According to the various embodiments, the electric connecting member may be extended as a zigzag shape.

According to the various embodiments, the first member may include at least one of PC, TR90, stainless steel, or aluminum and the second member may include at least one of urethane, silicone, rubber, TPU or TPSiV.

According to the various embodiments, the strap includes at least one band recess. The band recess may include at least one groove formed on the first member and extended in a longitudinal direction of the at least one strap and in an actually perpendicular direction and a part, which is a part of the second member, formed along curves of a surface of the at least one groove.

According to the various embodiments, the electronic watch may further include a buckle coupled to at least one part of the at least one strap and the buckle may include a speaker electrically coupled to the main body.

According to the various embodiments, the buckle may further include a containing space for containing the speaker, a containing opening formed on a side of the buckle, and a cover covering the containing space. The at least one strap may be extended to the containing space through the containing opening.

According to the various embodiments, an end of the at least one strap may include a mounting protrusion to be inserted into the containing opening and an electric connecting unit electrically coupled to the speaker.

According to the various embodiments, the at least one strap may further include at least one ring-shaped protrusion formed along an outer circumferential surface of the mounting protrusion.

According to the various embodiments, the at least one strap may include a first member and a second member enclosing at least one part of the first member. The first member may include a part extended from at least one side of the mounting protrusion, and the electric connecting unit may be extended along the extended part.

According to the various embodiments, the first member may include at least one penetration opening. The penetration opening may be disposed corresponding to at least one fastening opening formed in the containing opening and configured to be screw-fastened.

According to the various embodiments, the buckle may further include a sealing member surrounding at least one part of the cover located on a top of the speaker.

According to the various embodiments, the sealing member may include a cover sealing member disposed along an edge of the containing space and a screw sealing member disposed in a location corresponding to a screw fastening opening fastened to a fastening opening formed in the containing space through the cover.

According to the various embodiments, the fastening unit may be at least one band fixing pole protruding from an outer surface of the cover and correspondingly inserted into at least one opening formed in the at least one strap.

According to the various embodiments, a buckle link installed on an outer surface of the buckle to be pivotable and supporting the at least one strap while being fastened. The fastening unit may be disposed on the buckle link.

According to the various embodiments, the buckle link may include a first link installed on an outer surface of the housing to allow one end to be pivotable, a second link installed on another end of the first link to be pivotable, and a hanging member installed with at least one band fixing pole to be correspondingly inserted into at least one opening formed in the at least one strap.

According to the various embodiments, the main body may include a first case frame mounted with at least one first electronic component, a second case frame coupled with the first case frame and mounted with at least one second electronic component, and a substrate unit contained in a space formed by a combination of the first case frame and the second case frame and electrically coupled to the first electronic component and the second electronic component.

According to the various embodiments, the substrate unit may include a first substrate fixed to the first case frame, a second substrate fixed to the second case frame, and a connector electrically connecting the first substrate to the second substrate. The connector may be folded a plurality of times by overlapping.

According to the various embodiments, the connector may include one or more plates formed of a rigid material and a bent part formed of a flexible material disposed between the plates. The plates may be deposited to be bent and overlapped by the bent part.

According to the various embodiments, the plate and the bent part have identical widths of signal wirings but have hatch patterns of different density from each other.

The various embodiments also provide a wearable electronic device including a main body including a processor, a wearable member coupled to at least one part of the main body, and at least one electronic component mounted on a part of the wearable member.

According to the various embodiments, the at least one electronic component may include at least one of a camera, a speaker, a microphone, a vibrating device, a sensor, or an antenna.

According to the various embodiments, the wearable member may include a first member mounted with the at least one electronic component and a second member enclosing at least one part of the first member.

According to the various embodiments, the wearable member may include a hole formed through the first member and the second member and at least one part of the at least electronic component may be located in the hole.

According to the various embodiments, a part of the at least one electronic component is exposed through a first surface of the wearable member and there is further include a sealing member located on a second surface of the wearable member and covering the at least one hole.

According to the various embodiments, the wearable member may include a hole formed through the first member and a first surface of the second member and at least one part of the hole may enclose a second surface of the second member.

According to the various embodiments, the wearable member may include a hole penetrating at least one part of the first member and at least one part of the hole may be formed to enclose the second member.

According to the various embodiments, the wearable member may further include a sealing member. The at least one electronic component may be enclosed by one or more of the at least one part of the first member, at least one part of the second member, and the sealing member.

According to the various embodiments, the wearable member may include a hole penetrating a part of the second member and extended to a part of the first member. The at least one electronic component may be mounted on the part of the first member, and the sealing member may enclose the hole.

According to the various embodiments, the main body may include a first case frame mounted with at least one first electronic component, a second case frame coupled with the first case frame and mounted with at least one second electronic component, and a substrate unit contained in a space formed by a combination of the first case frame and the second case frame and electrically coupled to the first electronic component and the second electronic component.

According to the various embodiments, the substrate unit may include a first substrate fixed to the first case frame, a second substrate fixed to the second case frame, and a connector electrically coupling the first substrate to the second substrate. The connector may be folded a plurality of times by overlapping.

According to the various embodiments, the connector may include one or more plates formed of a rigid material and a bent part formed of a flexible material disposed between the plates. The plates may be deposited to be bent and overlapped by the bent part.

According to the various embodiments, the plate and the bent part have identical widths of signal wirings but have hatch patterns of different density from each other.

According to the various embodiments, the wearable electronic device may include a housing containing at least one electronic component coupled to at least one part of the at least one wearable member.

According to the various embodiments, the housing may further include a containing space for containing the electronic component, a containing opening formed on a side of the housing, and a cover covering the containing space. The at least one wearable member may be extended to the containing space through the containing opening.

According to the various embodiments, an end of the at least one wearable member may include a mounting protrusion to be inserted into the containing opening and an electric connecting unit electrically coupled to the electronic component.

According to the various embodiments, the at least one wearable member may further include at least one ring-shaped protrusion formed along an outer circumferential surface of the mounting protrusion.

According to the various embodiments, in the at least one wearable member, the first member may include a part extended from at least one side of the mounting protrusion, and the electrical connecting unit may be extended along the extended part.

According to the various embodiments, the first member may include at least one penetration opening. The penetration opening may be disposed corresponding to at least one fastening opening formed in the containing opening and configured to be screw-fastened.

According to the various embodiments, the housing may further include a sealing member surrounding at least one part of the cover located on a top of the electronic component.

According to the various embodiments, the sealing member may include a cover sealing member disposed along an edge of the containing space and a screw sealing member disposed in a location corresponding to a screw fastening opening fastened to a fastening opening formed in the containing space through the cover.

The various embodiments may provide a method including receiving an image taking command at the main body, transmitting an image obtaining command from the main body to the camera module based on the image taking command, obtaining an image by the camera module, and transmitting the obtained image to the main body. In one embodiment, the method may be applied to at least one of the electronic device, the electronic watch, or the wearable electronic device.

The various embodiments may provide a method including receiving a sound playback command at the main body, processing sound data to be played back at the main body, transmitting the processed sound data to the speaker, and replaying the sound at the speaker. In one embodiment, the method may be applied to at least one of the electronic device, the electronic watch, or the wearable electronic device.

Definitely, there are various methods of modifying the embodiments within an ambit of the claims of the present disclosure. In other words, without being out of the ambit of the following claims, there will be many other methods of executing the present disclosure.

The various embodiments may provide an electronic watch including a main body including a display and at least one strap having one end coupled to at least one part of the main body and including a mounting unit mounted with an electronic component electrically coupled to the main body, the strap enclosing at least one part of an external object or attached to the at least one part.

The various embodiments may provide an electronic device including a main body including a display and at least one strap having one end coupled to at least one part of the main body and including a mounting unit mounted with an electronic component electrically coupled to the main body, the strap enclosing at least one part of an external object or attached to the at least one part.

The various embodiments may provide a wearable electronic device including a main body and at least one strap fixed to the main body, in which the strap includes a core member mounted with at least one electronic component and a band member coupled with the core member while enclosing at least one part of the core member, disposed with the electric connecting member, and the at least one electronic component is electrically coupled to the main body through the electric connecting member.

The various embodiments may provide a wearable electronic device including a main body and at least one strap fixed to the main body, in which the strap includes a core member, an FPC fixed to both sides of the core member while penetrating one surface of the core member and another surface opposite to the one surface, a sealing member installed to seal a part of the core member penetrated by the FPC, a band member formed by a double injection process to enclose at least one part of the core member disposed with the FPC and the sealing member and having softer materials than the core member, at least one electronic component installed to be electrically coupled to the FPC exposed to at least one part of the band member, and a cover mounted to seal an exposed part of the band member mounted with at least one electronic component.

The various embodiments may provide a main body, at least one strap fixed to the main body, and a buckle installed on an end of the strap to be fastened to another strap and mounted with at least one electronic component, in which the buckle includes a housing fixed to the end of the strap and mounted with the at least one electronic component and a fastening unit disposed on an outer surface of the housing and fastened to the other strap.

The various embodiments may provide a wearable electronic device including a main body, at least one strap fixed to the main body, a housing installed on an end of the strap and having a unit containing space therein, at least one electronic component contained in the unit containing space of the housing, a cover for sealing the unit containing space, at least one sealing member disposed between the cover an the unit containing space for sealing, and at least one band fixing pole protruding from an outer surface of the cover and correspondingly inserted into at least one opening formed on another strap.

The various embodiments may provide a wearable electronic device including a main body, at least one strap fixed to the main body, and a buckle installed on an end of the strap to be fastened to another strap and mounted with at least one electronic component, in which the strap includes a core member mounted with the at least one electronic component, an electric connector disposed on the core member, and a band member coupled with the core member to enclose at least one part of the core member disposed with the electric connector, the at least one electronic component is electrically coupled to the main body through the electric connector, and the buckle includes a housing fixed to an end of the strap and mounted with the at least one electronic component, and a fastening unit disposed on an outer surface of the housing and fastened to another strap.

The various embodiments may provide a method including receiving an image taking command at the main body, transmitting an image obtaining command from the main body to the camera module based on the image taking command, obtaining an image by the camera module, and transmitting the obtained image to the main body. In one embodiment, the method may be applied to at least one of the electronic device, the electronic watch, or the wearable electronic device.

The various embodiments may provide a method including receiving a sound playback command at the main body, processing sound data to be played back at the main body, transmitting the processed sound data to the speaker, and replaying the sound at the speaker. In one embodiment, the method may be applied to at least one of the electronic device, the electronic watch, or the wearable electronic device.

According to the various embodiments, since a strap is doubly formed of materials having softness different from each other, an electronic device may be reliable although being used for a long time, an assembling structure with a main body may improve, and electronic components may be easily installed on the strap.

According to the various embodiments, at least one of a camera module or a speaker module on a strap extended from a main body is disposed as an electronic component, thereby providing a wearer with convenience of using an electronic device.

According to the various embodiments, a strap is formed by using a plurality of supporting members, thereby providing operational safety of a camera module.

According to the various embodiments, when at least two substrates are electrically coupled, a larger number of signal lines may be contained, assembling may become easy, and space availability may be maximized.

According to the various embodiments, fastening and releasing are easy, space availability improves and simultaneously with providing various functions, and a beautiful external shape is provided, thereby providing reliability of an electronic device.

What is claimed is:

1. A wearable electronic device comprising:

a main body comprising a processor;

a wearable member coupled to at least one part of the main body, the wearable member defining an opening exposing an interior of the wearable member; and at least one electronic component including a lens mounted on a part of the wearable member, wherein at least a portion of the at least one electric component is disposed within the opening defined by the wearable member such that light is detectable to the lens through the opening, and wherein the opening is defined in the wearable member within a reinforced washer that is insert-molded into a core member disposed within the wearable member.

2. The wearable electronic device of claim 1, wherein the wearable member comprises:

a first member mounted with the at least one electronic component; and a second member enclosing at least one part of the first member.

3. The wearable electronic device of claim 2, wherein the opening is formed as to define the opening through the first member and the second member.

4. The wearable electronic device of claim 3, wherein a part of the at least one electronic component is exposed through a first surface, the wearable electronic device further comprising a sealing member located on a second surface of the wearable member, facing a direction opposite to the first surface and covering the opening.

5. The wearable electronic device of claim 1, wherein the wearable member comprises at least one strap coupled to at least one part of the main body, and wherein the electronic component comprises at least one camera module including the lens mounted on a part of the at least one strap.

6. The wearable electronic device of claim 5, wherein the at least one camera module comprises the lens exposed through a first surface of the at least one strap, the wearable electronic device further comprising a sealing member exposed to a second surface of the at least one strap and adjacent to the camera module.

7. The wearable electronic device of claim 5, further comprising an electric coupler electrically coupling the main body and the camera module.

8. The wearable electronic device of claim 5, further comprising a buckle coupled to at least one part of the at least one strap, the buckle comprising a speaker electrically coupled with the main body.

9. The wearable electronic device of claim 8, wherein the buckle further comprises:

a containing space for at least partially enclosing the speaker;

a containing opening formed on a side of the buckle; and a cover covering the containing space, wherein the at least one strap extends into the containing space through the containing opening.

10. The wearable electronic device of claim 9, wherein an end of the at least one strap comprises a mounting protrusion to be inserted into the containing opening and an electric connecting unit electrically coupled to the speaker.

11. The wearable electronic device of claim 10, wherein the at least one strap further comprises at least one ring-shaped protrusion formed along the mounting protrusion.

12. The wearable electronic device of claim 8, further comprising a buckle link installed on an outer surface of the buckle to be pivotable and supporting the at least one strap when being fastened, wherein a fastening unit is disposed on the buckle link.

13. The wearable electronic device of claim 12, wherein the buckle link comprises:

a first link installed on an outer surface of a housing to allow one end thereof to be pivotable;

a second link installed on another end of the first link to be pivotable; and at least one band fixing pole formed on an end of the second link to be correspondingly inserted into at least one opening formed on the at least one strap.

14. The wearable electronic device of claim 5, wherein the main body comprises:

a first case frame mounted with at least one first electronic component;

a second case frame coupled with the first case frame and mounted with at least one second electronic component; and a substrate unit contained in a space formed by a combination of the first case frame and the second case frame and electrically coupled to the first electronic component and the second electronic component.

15. The wearable electronic device of claim 14, wherein the substrate unit comprises:

a first substrate fixed to the first case frame;

a second substrate fixed to the second case frame;

a connector electrically coupling the first substrate and the second substrate to each other, wherein the connector is folded a plurality of times to be overlapped, wherein the connector comprises:

at least two plates formed of a rigid material; and a bent portion, disposed between the at least two plates, and formed of a soft material, and wherein the at least two plates are folded along the bent portion.

16. A wearable electronic device comprising:

a main body; and at least one strap fixed to the main body, the at least one strap defining an opening exposing an interior of the at least one strap, wherein the strap comprises:

a core member mounted with at least one electronic component including a lens;

an electric connector disposed on the core member;

a band member enclosing at least one part of the core member disposed with the electric connector, wherein the at least one electronic component is electrically coupled to the main body through the electric connector, wherein at least a portion of the at least one electric component is disposed within the opening defined in the at least one strap such that light is detectable to the lens through the opening, and wherein the opening is defined within a reinforced washer that is insert-molded into the core member.

17. A wearable electronic device comprising:

a main body; and at least one strap fixed to the main body, wherein the strap comprises:

a core member;

a flexible printed circuit penetrating one surface of the core member and another surface opposite to the one surface and fixed to the both surfaces;

a sealing member installed to seal a part of the core member penetrated by the flexible printed circuit;

a band member formed using a double injection process to enclose at least one part of the core member disposed with the flexible printed circuit and the sealing member and formed of softer material than the core member;

at least one electronic component installed to be electrically coupled to the flexible printed circuit exposed to at least one part of the band member; and a cover mounted to seal an exposed part of the band member mounted with the electronic component.

18. A wearable electronic device comprising:

a main body;

at least one strap fixed to the main body, the at least one strap defining an opening exposing an interior of the at least one strap; and a buckle installed on an end of the strap to be fastened to another strap and mounted with at least one electronic component, wherein the buckle comprises:

a housing fixed to the end of the strap and mounted with the at least one electronic component; and a fastening unit disposed on an outer surface of the housing and fastened to the another strap, wherein at least one second electronic component including a lens is mounted on a part of the at least one strap, and at least a portion of the at least one second electronic component is disposed within the opening defined by the at least one strap such that light is detectable to the lens through the opening, and wherein the opening is defined in the strap within a reinforced washer that is insert-molded into a core member disposed within the strap.

19. A wearable electronic device comprising:

a main body;

at least one strap fixed to the main body, the at least one strap defining an opening exposing an interior of the at least one strap;

a housing installed on an end of the strap and having a unit containing space therein;

at least one electronic component including a lens contained in the unit containing space of the housing;

a cover for sealing the unit containing space;

at least one sealing member disposed between the cover and the unit containing space for sealing the unit containing space; and at least one band fixing pole protruding from an outer surface of the cover and correspondingly inserted into at least one opening formed on another strap, wherein at least one second electronic component is mounted on a part of the at least one strap, and at least a portion of the at least one second electronic component is disposed within the opening defined by the at least one strap such that light is detectable to the lens through the opening, and wherein the opening is defined in the strap within a reinforced washer that is insert-molded into a core member disposed within the strap.

20. A wearable electronic device comprising:

a main body;

at least one strap fixed to the main body, the at least one strap defining an opening exposing an interior of the at least one strap; and a buckle fixed to an end of the strap to be fastened to another strap and mounted with at least one second electronic component, wherein the strap comprises:

a core member mounted with at least one electronic component including a lens, such that at least a portion of the at least one electronic component is disposed within the opening defined by the at least one strap such that light is detectable to the lens through the opening;

an electric connector disposed on the core member;

a band member coupled with the core member to enclose at least one part of the core member disposed with the electric connector, wherein the at least one electronic component is electrically coupled to the main body through the electric connector, wherein the buckle comprises: a housing fixed to the end of the strap and mounted with the at least one second electronic component; and a fastening unit disposed on an outer surface of the housing and fastened to the another strap, and wherein the opening is defined within a reinforced washer that is insert-molded into the core member.

* * * * *